US010297108B2

(12) United States Patent
De Waal et al.

(10) Patent No.: US 10,297,108 B2
(45) Date of Patent: May 21, 2019

(54) GAMING SYSTEM AND METHOD PROVIDING A COLLECTION GAME

(71) Applicant: IGT, Las Vegas, NV (US)

(72) Inventors: Daniel De Waal, Las Vegas, NV (US); Lance R. Peterson, Reno, NV (US); Vincent P. Smith, Las Vegas, NV (US); Anthony J. Baerlocher, Henderson, NV (US); Kimberley Campbell, Reno, NV (US)

(73) Assignee: IGT, Las Vegas, NV (US)

( * ) Notice: Subject to any disclaimer, the term of this patent is extended or adjusted under 35 U.S.C. 154(b) by 88 days.

(21) Appl. No.: 15/214,053

(22) Filed: Jul. 19, 2016

(65) Prior Publication Data

US 2016/0328918 A1 Nov. 10, 2016

Related U.S. Application Data

(63) Continuation of application No. 14/173,384, filed on Feb. 5, 2014, now Pat. No. 9,401,066, which is a (Continued)

(51) Int. Cl.
*G07F 17/32* (2006.01)
*G07F 17/34* (2006.01)

(52) U.S. Cl.
CPC ..... *G07F 17/3255* (2013.01); *G07F 17/32* (2013.01); *G07F 17/323* (2013.01); (Continued)

(58) Field of Classification Search
CPC .. G07F 17/3255; G07F 17/32; G07F 17/3209; G07F 17/3225; G07F 17/3211; G07F 17/3272; G07F 17/323; G07F 17/34
(Continued)

(56) References Cited

U.S. PATENT DOCUMENTS 5,743,526 A 4/1998 Inoue
5,947,820 A 9/1999 Morro et al.
(Continued)

FOREIGN PATENT DOCUMENTS

EP 0 984 409 3/2000
WO WO 00/12186 3/2000
(Continued)

OTHER PUBLICATIONS

Bingo Game Advertisement, written by Casino Data Systems, published in 1998.
(Continued)

*Primary Examiner* — Michael A Cuff
(74) *Attorney, Agent, or Firm* — Neal, Gerber & Eisenberg LLP

(57) ABSTRACT

A gaming system and method providing a collection game independent from the primary games of a gaming system. In one embodiment, the collection game includes a plurality of elements and a winning element combination. During play of the collection game, randomly or upon an occurrence of a triggering event, the gaming system releases one of the plurality of elements to players. The gaming system repeats the process of releasing elements until one of the players collects all of the elements of the winning element combination. The first player to collect all of the elements of the winning element combination wins an award or prize.

18 Claims, 27 Drawing Sheets

Related U.S. Application Data continuation of application No. 11/936,342, filed on Nov. 7, 2007, now Pat. No. 8,678,906.

(52) U.S. Cl.
CPC ..... *G07F 17/3209* (2013.01); *G07F 17/3211* (2013.01); *G07F 17/3225* (2013.01); *G07F 17/3267* (2013.01); *G07F 17/3272* (2013.01); *G07F 17/3293* (2013.01); *G07F 17/34* (2013.01)

(58) Field of Classification Search
USPC ..... 463/18, 19, 20, 21
See application file for complete search history.

(56) References Cited

U.S. PATENT DOCUMENTS

| | | | |
|---|---|---|---|
| 6,346,043 | B1 | 2/2002 | Colin et al. |
| 6,364,765 | B1 | 4/2002 | Walker et al. |
| 6,461,241 | B1 | 10/2002 | Webb et al. |
| 6,464,582 | B1 | 10/2002 | Baerlocher et al. |
| 6,554,703 | B1 | 4/2003 | Bussick et al. |
| 6,632,139 | B1 | 10/2003 | Baerlocher |
| 6,652,378 | B2 | 11/2003 | Cannon et al. |
| 6,682,419 | B2 | 1/2004 | Webb et al. |
| 6,682,420 | B2 | 1/2004 | Webb et al. |
| 6,692,353 | B2 | 2/2004 | Walker et al. |
| 6,726,563 | B1 | 4/2004 | Baerlocher |
| 6,733,389 | B2 | 5/2004 | Webb et al. |
| 6,758,757 | B2 | 7/2004 | Luciano, Jr. et al. |
| 6,780,111 | B2 | 8/2004 | Cannon et al. |
| 6,840,858 | B2 | 1/2005 | Adams |
| 6,843,724 | B2 | 1/2005 | Walker et al. |
| 6,878,061 | B2 | 4/2005 | Baerlocher et al. |
| 6,929,952 | B2 | 8/2005 | Baerlocher |
| 6,981,917 | B2 | 1/2006 | Webb et al. |
| 7,040,983 | B2 | 5/2006 | Dolloff et al. |
| 7,056,214 | B2 | 6/2006 | Miereau et al. |
| 7,169,046 | B2 | 1/2007 | Webb et al. |
| 7,223,172 | B2 | 5/2007 | Baerlocher et al. |
| 7,229,350 | B2 | 6/2007 | Baerlocher et al. |
| 7,351,140 | B2 | 4/2008 | Wolf et al. |
| 8,678,906 | B2 | 3/2014 | De Waal |
| 2003/0125102 | A1 | 7/2003 | Cannon |
| 2003/0186733 | A1 | 10/2003 | Wolf et al. |
| 2003/0190945 | A1 | 10/2003 | Bussick et al. |
| 2003/0207709 | A1 | 11/2003 | Paotrakul |
| 2004/0106446 | A1 | 6/2004 | Cannon et al. |
| 2004/0110555 | A1 | 6/2004 | Devaull et al. |
| 2004/0171416 | A1 | 9/2004 | Baerlocher et al. |
| 2004/0209663 | A1 | 10/2004 | Webb et al. |
| 2005/0037832 | A1 | 2/2005 | Cannon |
| 2005/0043082 | A1 | 2/2005 | Peterson et al. |
| 2005/0049042 | A1 | 3/2005 | Walker et al. |
| 2005/0059468 | A1 | 3/2005 | Cannon |
| 2005/0059470 | A1 | 3/2005 | Cannon |
| 2005/0059471 | A1 | 3/2005 | Cannon |
| 2005/0064932 | A1 | 3/2005 | Cannon |
| 2005/0070353 | A1 | 3/2005 | Webb et al. |
| 2005/0096114 | A1 | 5/2005 | Cannon et al. |
| 2005/0153773 | A1 | 7/2005 | Nguyen et al. |
| 2005/0181860 | A1 | 8/2005 | Nguyen et al. |
| 2005/0192086 | A1 | 9/2005 | Walker et al. |
| 2006/0068874 | A1 | 3/2006 | Hornik et al. |
| 2006/0068883 | A1 | 3/2006 | Randall et al. |
| 2006/0068893 | A1 | 3/2006 | Jaffe et al. |
| 2006/0073879 | A1 | 4/2006 | Baerlocher |
| 2006/0073897 | A1 | 4/2006 | Englman et al. |
| 2006/0079309 | A1 | 4/2006 | Walker et al. |
| 2006/0094495 | A1 | 5/2006 | Gelber et al. |
| 2006/0111170 | A1 | 5/2006 | Hornik et al. |
| 2006/0121971 | A1 | 6/2006 | Slomiany et al. |
| 2006/0121972 | A1 | 6/2006 | Walker et al. |
| 2006/0160625 | A1 | 7/2006 | Englman et al. |
| 2006/0189379 | A1 | 8/2006 | Pacey |
| 2006/0205465 | A1 | 9/2006 | Dolloff et al. |
| 2006/0264257 | A1 | 11/2006 | Jaffe et al. |
| 2006/0287035 | A1 | 12/2006 | Walker et al. |
| 2007/0060287 | A1 | 3/2007 | Reddicks et al. |
| 2007/0060297 | A1 | 3/2007 | Hein et al. |
| 2007/0077979 | A1* | 4/2007 | Cohn ..... G07F 17/3244 463/16 |
| 2007/0117610 | A1 | 5/2007 | Webb et al. |
| 2007/0123341 | A1 | 5/2007 | Tessmer et al. |
| 2007/0202943 | A1 | 8/2007 | Thomas |
| 2007/0213119 | A1 | 9/2007 | Baerlocher et al. |
| 2007/0259706 | A1 | 11/2007 | Anderson et al. |
| 2007/0259714 | A1 | 11/2007 | Block et al. |
| 2007/0298856 | A1 | 12/2007 | Gilmore et al. |
| 2008/0113771 | A1* | 5/2008 | Baerlocher ..... G07F 17/32 463/25 |
| 2009/0181776 | A1 | 7/2009 | Deng |
| 2010/0029367 | A1 | 2/2010 | Englman et al. |

FOREIGN PATENT DOCUMENTS

| | | |
|---|---|---|
| WO | WO 2005/020159 | 3/2005 |
| WO | WO 2005/029422 | 3/2005 |
| WO | WO 2005/113088 | 12/2005 |
| WO | WO 2006/121663 | 11/2006 |
| WO | WO 2007/142980 | 12/2007 |

OTHER PUBLICATIONS

Class II Bingo Advertisement, written by IGT, published in 2004.

Five Card Instant Bingo Advertisement, written by IGT, published in 2000.

Instant Bingo Video Slots Advertisement, written by IGT, published in 2002.

Jackpot Bingo Advertisement [online] [retrieved on Apr. 12, 2001]. Retrieved from the Internet at <URL: http://www.cds.com>.

McDonald's Monopoly Game Description [online] [retrieved on Jan. 23, 2008, available prior to Nov. 7, 2007]. Retrieved from the Internet at <URL: http://en.wikipedia.org>.

McDonald's Monopoly Official Rules [online] [retrieved on Jan. 23, 2008, available prior to Nov. 7, 200], Retrieved from the Internet at <URL: hhttp://monopoly.corsis.com>.

Multi-Card Bingo Article, written by Strictly Slots, published in Mar. 2001.

Pocket Tetris Game Description, written by Radica, published in 2000.

Peppermillions Article [online] [retrieved on Oct. 4, 2007]. Retrieved from the Internet at <URL: http://www.peppermillreno.com>.

* cited by examiner

FIG. 8A

500

| Collection Game Level | Probability of Occurrence | Trigger Range |
|---|---|---|
| 1 | 45% | 3 to 15 minutes |
| 2 | 40% | 4 to 20 minutes |
| 3 | 15% | 5 to 30 minutes |

FIG. 8B

502

| Collection Game Level | Contribution |
|---|---|
| 1 | 0.06% |
| 2 | 0.08% |
| 3 | 0.11% |
| Total | 0.25% |

504

| Collection Game Level | Pairs | Matrix Size |
|---|---|---|
| 1 | 8 | 4 X 4 |
| 2 | 12 | 4 X 6 |
| 3 | 16 | 4 X 8 |

GAMING SYSTEM AND METHOD PROVIDING A COLLECTION GAME

PRIORITY CLAIM

This application is a continuation of, and claims priority to and the benefit of, U.S. patent application Ser. No. 14/173,384, which was filed on Feb. 5, 2014, which is a continuation of, and claims priority to and the benefit of U.S. patent application Ser. No. 11/936,342, which was filed on Nov. 7, 2007, and issued as U.S. Pat. No. 8,678,906 on Mar. 25, 2014, the entire contents of each of which are incorporated herein by reference.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming establishment or casino loyalty programs are a popular way to reward players for playing at a gaming establishment. Gaming establishment loyalty programs typically work in conjunction with player tracking systems to offer incentives to players in exchange for the player's loyalty to the gaming establishment. Such loyalty incentives are often provided and funded by the gaming establishment's marketing department. Current gaming establishment loyalty programs have a limited number of mechanisms or ways to deliver such loyalty incentives to players as part of their gaming experience.

One way to provide loyalty incentives to players is by offering the player a chance to obtain one symbol a day as part of a designated symbol combination, which is associated with a prize. For instance, the Peppermill Casino in Reno, Nev., offers a "Peppermillions" drawing. In the "Peppermillions" drawing, the casino provides the players the ability to collect one symbol a day. Once a day, a carded player can swipe their player card at a designated kiosk to receive a letter in the word "Peppermillions." The kiosk prints off a letter for the player. The first player who able to collect the printed out letters which spell the word "Peppermillions" wins a prize. Currently, players are only allowed to obtain one letter a day. This type of promotion is known as a collect and win or persistence promotion. Additionally, each winner is entered into one or more drawings to win another prize, such as a television, a car or a cash prize.

There are many drawbacks to such promotional games. The overhead associated with such drawings, ticket printing, and management can be expensive. There is little motivation for the player to stay and play at the gaming establishment after obtaining the letter entry for the day because the player may only collect one letter a day. Further, there is no strategy on the part of the player. The player just has to swipe a player card. The timing at which the player swipes their player card to receive the letter has no bearing on the outcome of which letter they will receive. Additionally, a player must stop playing at a gaming machine and go to a kiosk to enter the drawing. The kiosk awards physical tickets with the letters printed on it, and the player has to keep track of their own progress by saving the physical tickets. The tickets pose theft and security risks if the ticket is not assigned to the player. Additionally, even if the tickets are assigned to a specific player, if the player loses the ticket, the ticket is not replaced. A player may have won the game, but by losing a ticket, the player is unable to prove their win and collect the prize.

Certain known gaming devices include secondary bingo games where each of the bingo cards is associated with a different one of a plurality of reels. The gaming device spins the reels for plays of the primary game and for each respective reel, provides bingo numbers for the bingo card associated with the reel based on the symbols generated on the reel. The bingo games are played on a single gaming machine and do not transfer from one gaming machine to another gaming machine.

Accordingly, gaming establishments are in need of new and exciting ways to provide promotional awards to players as part of their gaming experience.

SUMMARY

The present disclosure is directed towards a gaming system that in one embodiment, includes a collection or persistence game that is independent from the primary games of a gaming system. In one embodiment, the collection game includes a plurality of elements and a winning element combination. During play of the collection game, randomly or upon an occurrence of a triggering event, the gaming system releases one of the plurality of elements to players. In one embodiment, the gaming system enables qualified players to make an input at one of the gaming machines to collect the released element. The gaming system repeats the process of releasing elements until one of the players collects all of the elements of the winning element combination. The first player to collect all of the elements of the winning element combination wins a designated award or prize. In one embodiment, the gaming system restricts the players from collecting elements based on time intervals. That is, the gaming system determines player qualification based on when the player last collected an element. In one embodiment, the player may only collect one element in a given time period though more than one element may have been released in that time period, adding an element of strategy to the collection game.

More specifically, in one embodiment, the gaming system includes a central controller and a plurality of gaming machines. The gaming system includes a collection game including a plurality of elements and at least one winning combination of elements. The gaming system enables players to register to play the collection game. The gaming system begins the collection game by informing players of the winning element combination, such as by displaying the winning element combination to players when they register. The gaming system enables players to play primary games. In one embodiment, the gaming system enables the player to play any gaming machine in the gaming establishment or a plurality of different types of games and play the collection game on any of those gaming machines. The gaming system begins the collection game by releasing one of the plurality of elements. The gaming system enables players to enroll or otherwise be allowed to make inputs on the gaming machines or a kiosk and select to collect that released element for a limited time period. If a player is already playing a gaming machine, the player may collect that element without leaving that gaming machine. In one embodiment, the collection game can be played over multiple plays of the base or primary game. In one embodiment, the gaming system only enables players to collect elements at certain increments. For example, the gaming system releases an element every thirty minutes, but only enables a player to collect an element every sixty minutes. Therefore, the player must strategize on when to collect an element in the sixty minute period. In various embodiments, the gaming system provides the players all, some or no information about what elements will be released and in what order and when they will be released. In various embodiments, the first player or players to collect a specified subset of the elements wins an award or prize.

In other embodiments, the gaming system provides multiple players awards in the play of a single collection game. For example, the gaming system provides each player who collects all of the elements in the winning element collection in the same round an award, regardless of the time they collected all of the elements in the winning element collection. In one embodiment, the gaming system provides multiple awards throughout the collection game. For example, if the winning element combination is two words, the gaming system provides the player who collects all of the elements of one of the words first an award. The gaming system may provide any suitable numbers of players an award during play of a single or multiple collection games.

For example, the gaming system begins a collection game at 8:00 am. In one embodiment, the sequence in which the elements are released is locked in at this time. That is, the gaming system releases the elements in a predetermined order in this embodiment; although it should be appreciated that the gaming system may determine and release elements in other ways. The gaming system enables the registered players to each identify themselves at one of the gaming machines. In one embodiment, the elements are letters and the winning element combination is the word "vehicle." Therefore, for a player to win, they must be the first player to collect the letter v, the letter e, the letter h, the letter i, the letter c, the letter l and the letter e. The prize is a car. The gaming system releases a first letter j at the beginning of the game. Thirty minutes later the gaming system releases the letter c. The registered players may only select one letter every sixty minutes. If a player collected the letter j, the player may not collect the letter c which is in the winning element combination. This process continues until a player collects each letter of the winning element combination. In one embodiment, if the qualified player needs the letter, it is added to their collected symbols. If the qualified player does not need the letter, the letter is discarded as it does not make a difference in the outcome of the game. In one embodiment, the gaming system prompts players to return every sixty minutes or to keep playing the game for the release of a new letter. Choosing what time to play is thus essential in obtaining all of the letters, symbols or game elements needed to win the collection game. That is, in one embodiment, the gaming system provides the player a game where the players strategize to collect elements to obtain a winning element combination. In one embodiment, the players make a decision of whether or not to collect a released element before the player is aware of what the element is. In another embodiment, the gaming system provides the player a clue as to what element will be released without revealing the element. For example, the gaming system may inform the players the element is a number between 10 to 20 or that the element is a vowel. It should be appreciated that the gaming system may provide players any suitable type of hints or clues about which element will be released. In various embodiments, the players may work together or in teams to constantly monitor the released elements, creating camaraderie between players and an overall enhanced gaming experience.

It should be appreciated that the gaming system may release the elements or make the elements available for collection in any suitable manner.

It should be appreciated that the collection game or persistence game may be any suitable game. In one embodiment, the winning element combination for the collection game is the same for each player. In another embodiment, the winning element combination for one or more players is different. For example, in one embodiment, at the beginning of a collection game, the player is provided a unique game board, such as a bingo card. The gaming system determines one or more winning bingo board patterns. The player secures or collects bingo numbers as they are released by the gaming system. In one embodiment, the gaming system marks each collected bingo number on each active player's bingo card. The bingo game continues until the winning bingo board pattern has been achieved by one of the players. In one embodiment, once a player signs up and receives a bingo card, if they are actively playing on a gaming machine, they collect the bingo numbers as they are released if they are included on that player's game card. In one embodiment, the player must make an input to actively collect a bingo number. In another embodiment, if a player is playing one of the gaming machines, the gaming system automatically collects the bingo number for the player if they are included on that player's game card. In one embodiment, the gaming system provides a player a limited time period to collect a released bingo number. For example, if a player has a number on their card that has been released, they have 15 minutes to claim that number. It should be appreciated that the time period may be different for different players. The time period may be based on any suitable criteria such as the player ranking.

In one embodiment, a persistence or collection game is based, in part, on the skill of a player. The player interaction provides greater excitement and additional player control. For example, in one embodiment, the persistence game is a matching game where the player receives a unique game board that remains unchanged for the persistence game. Thus, the longer a player plays the game and attempts to win, the better acquainted the player is with their game board and the player's chance of completing the game board quicker is increased. In one embodiment, the player makes selections of the game board to reveal elements and to try to match all elements of the persistence game before any other player.

For example, the game is a matching game where each player receives a unique game board which includes a matrix including a plurality of cells. In one embodiment, upon an occurrence of a triggering event, the gaming system enables the player to select two cells of that player's game board to reveal two elements. If the player selects matching elements, the gaming system enables the player to select two more cells to try to match two more elements. If the player selects cells that reveal unmatching elements, the player has to wait for another round to try again. In one embodiment, all elements on the player's board are covered or hidden at the beginning of each round so the player has to use prior knowledge to reveal any previously made matches. Players playing the game longer have an advantage over new players because they are more familiar with their game board. The game continues until a player correctly matches all of the elements.

In one embodiment, there are a number of different prize or award levels for a collection game, at which the players may compete. In different embodiments, the players may compete in one, a plurality or all of the available award levels. For example, a first award level has a smaller prize that is won on average once a day and a second award level has a larger prize that is won on average once a week.

In one embodiment, where the player is trying to collect elements for multiple games at the same time, in one embodiment, the player must strategize as to which level they collect games elements for. In one embodiment, if a player is playing multiple games which each have a different winning element combination, when an element is released, the player determines which game to use the element in. For example, if the player is playing a first game with the winning element combination of "automobile" to win an automobile and simultaneously playing a second game with the winning element combination of "holiday" to win a vacation and an "a" is released, the player determines whether to use the "a" in the automobile game or the holiday game. The player may use any suitable strategy to determine which game to use the released element. For example, if the player has completed more letters in the holiday game, the player may use the "a" element in the holiday game. In another example, if the player wants to win an automobile more than a vacation, the player may use the "a" element in the automobile game.

In another embodiment where players play multiple collection games simultaneously, one or more players may use a released element in more than one collection game. For example, the player may use a released element in any suitable collection game that player is playing. In another example, only certain players may use the released element in multiple simultaneously played collection games. For example, players of a certain high player ranking may use the released element in multiple games and players of a certain low player ranking may only use the released element in a single game. It should be appreciated that the gaming system may determine which players may use a single element multiple times in any suitable manner. It should be appreciated that the gaming system may enable any suitable number of players to use a released element in any suitable number of games or any suitable number of times in a single game.

It should be appreciated that the awards or prizes of the collection game may be funded in any suitable manner. In one embodiment, one or more awards are funded by percentages of participating player's wagers. That is, one or more of the awards are funded through a contribution of a percentage of each eligible player's gaming. Thus, the awards the players are competing for increase the longer it takes for a player to win the collection or persistence game. As increased numbers of players play the collection game, the awards for the collection game increase. This provides an exciting dynamic as more players join and more time passes without winning. The funding also enables the designer to allocate the funds in any appropriate manner. This enables the more challenging games to be appropriately funded such that they are associated with a higher award amount.

Accordingly, one embodiment of the gaming system disclosed herein provides the gaming establishment the flexibility to provide a collection game to a plurality of players that is independent from a base or primary game. Therefore, the players may play at their favorite gaming machine and participate in a system wide collection game without leaving the gaming machines. In one embodiment, the gaming system provides the player a game where the players strategize to collect elements to obtain a winning element combination. The players may work together or in teams to monitor the released elements, creating camaraderie between players. In another embodiment, the gaming system provides the players a collection game where each player has a unique game board and each player attempts to collect certain of the elements or all of the elements of that player's game board. In another embodiment, the gaming system provides the players a skill game. The gaming system of the present disclosure provides an electronic collection or persistence game that automates a collect and win game. In different embodiments, the gaming system of the present disclosure allows for the timing of the player's play or player's collection to determine which elements they will be able to collect and provides incentive for players to continue play of the gaming machines.

Additional features and advantages are described herein, and will be apparent from, the following Detailed Description and the figures.

BRIEF DESCRIPTION OF THE FIGURES

FIG. 8A is a chart illustrating a plurality of levels of a collection game and a probability of occurring.

FIG. 8B is a chart illustrating different wager contribution levels for different levels of the collection game.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
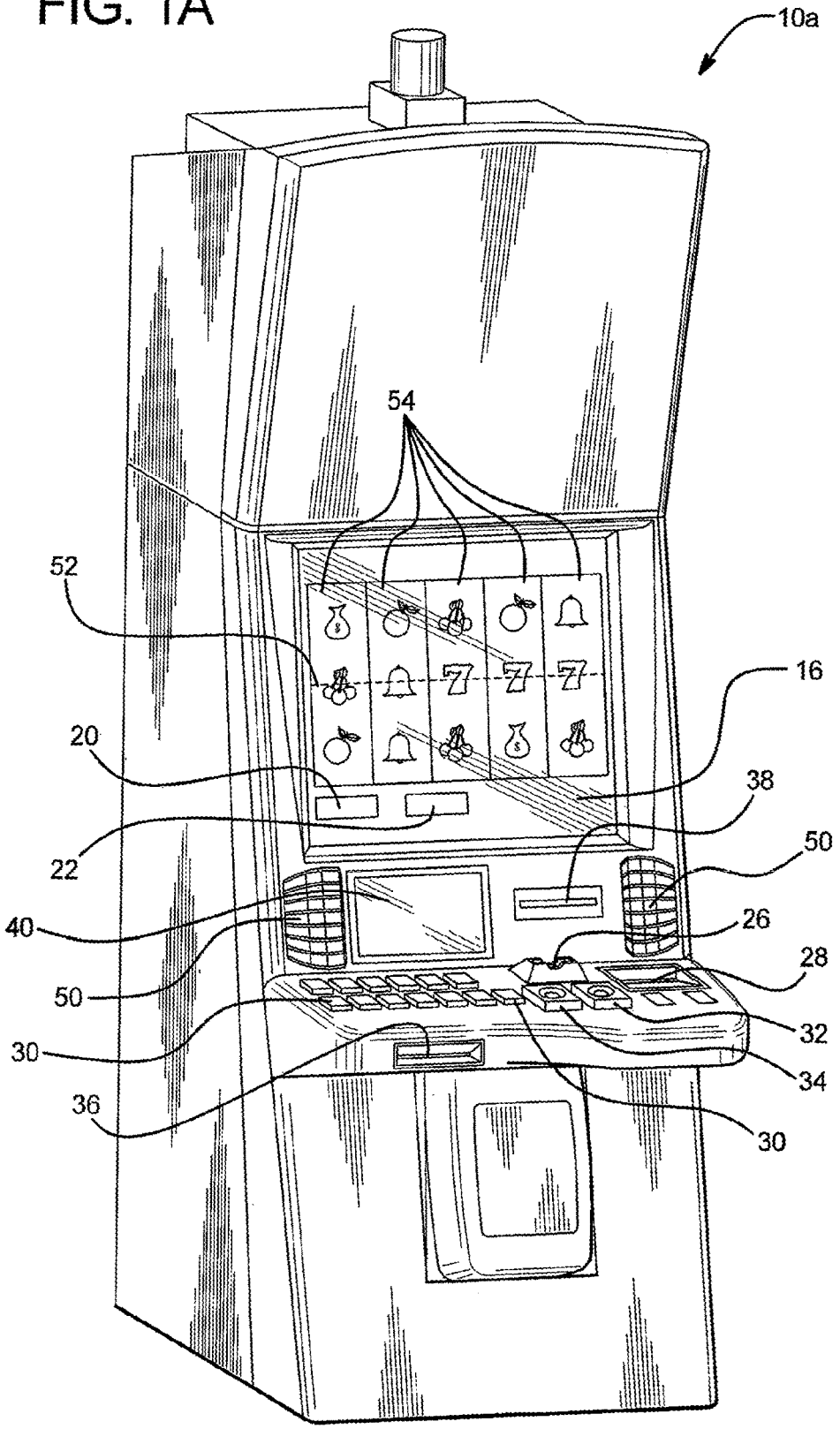
FIGS. 1A and 1B are front perspective views of alternative embodiments of gaming machines disclosed herein.
Figure 1B:
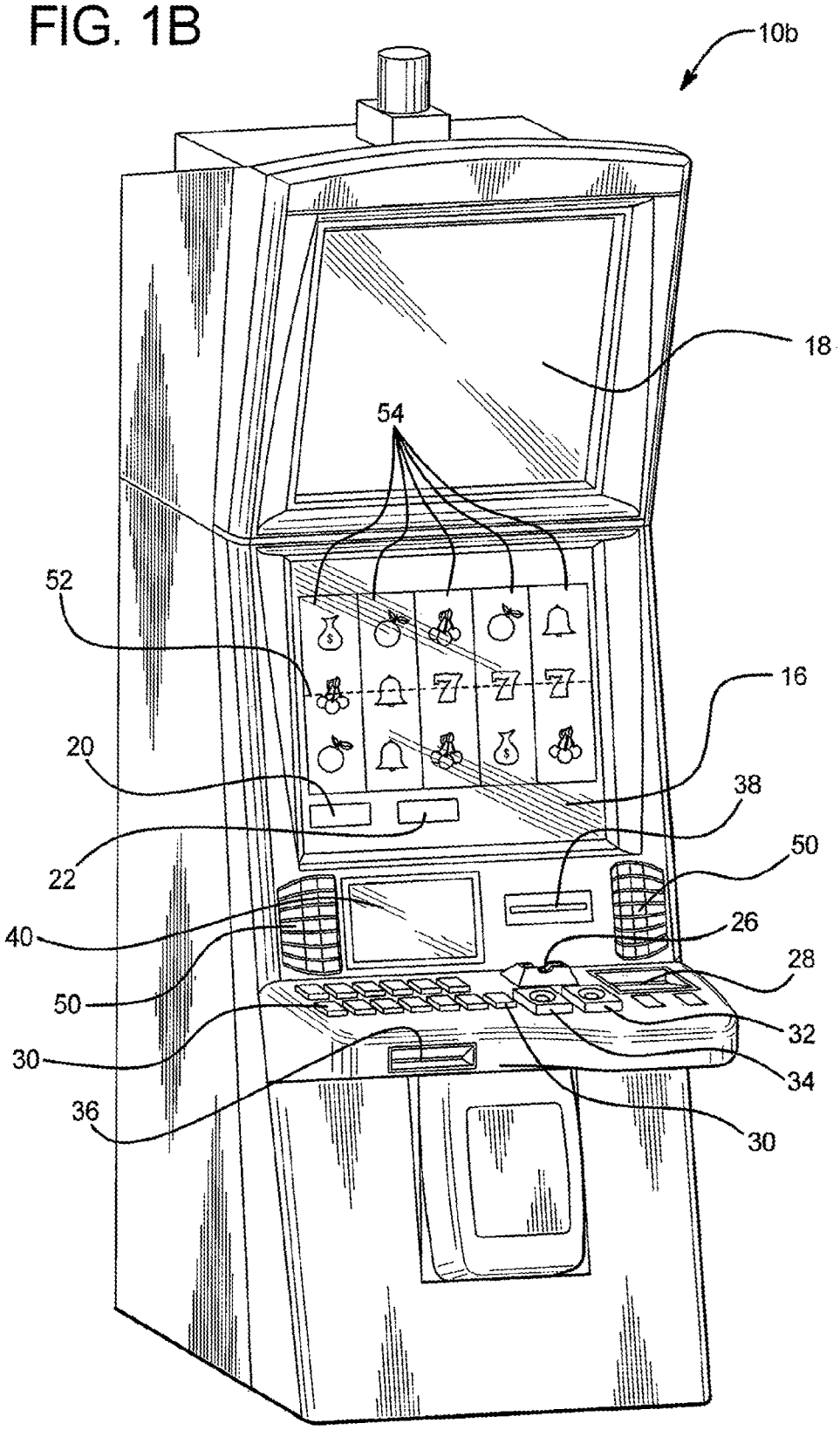

Referring now to the drawings, two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
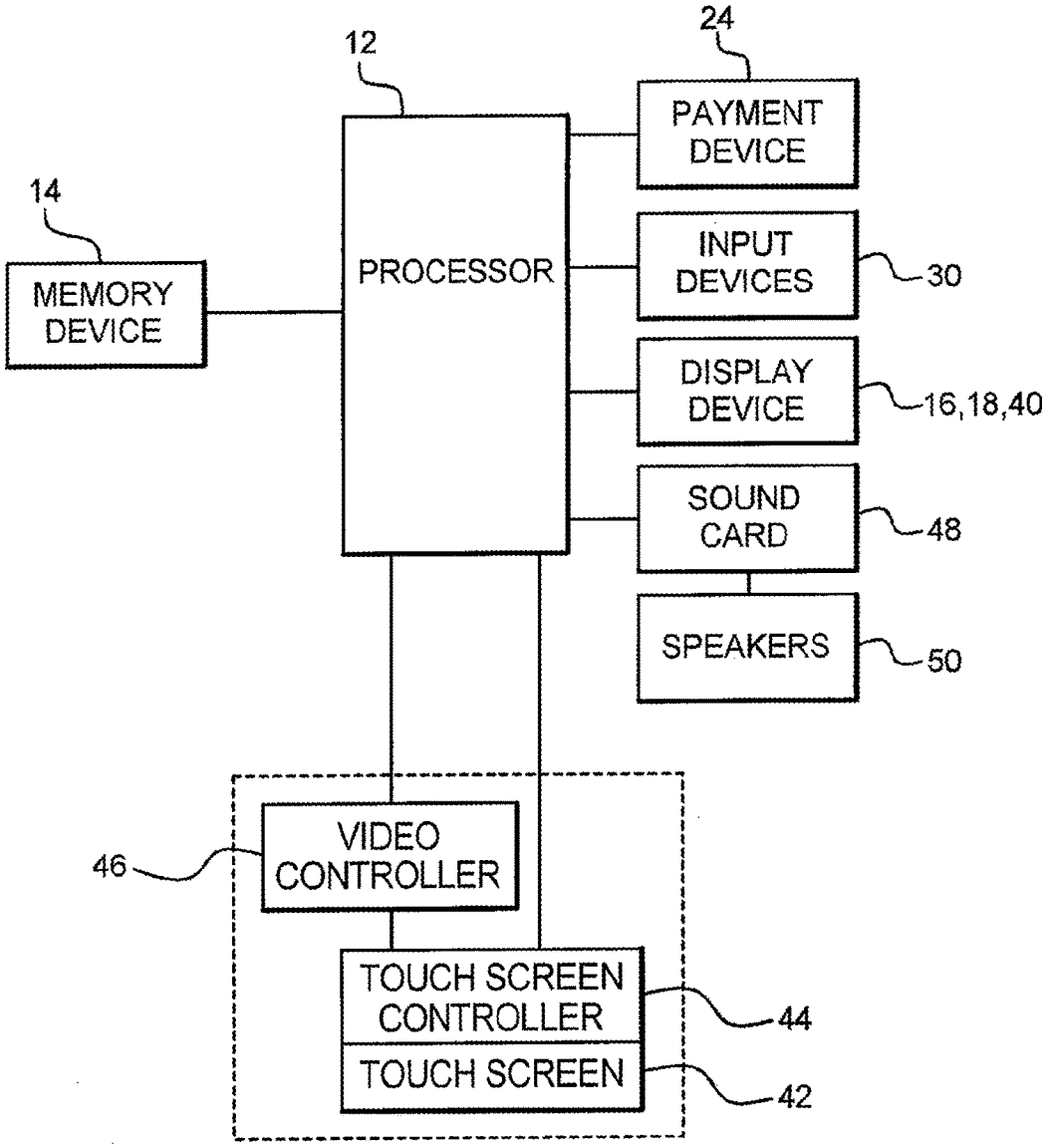
FIG. 2A is a schematic block diagram of the electronic configuration of one embodiment of a gaming machine disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
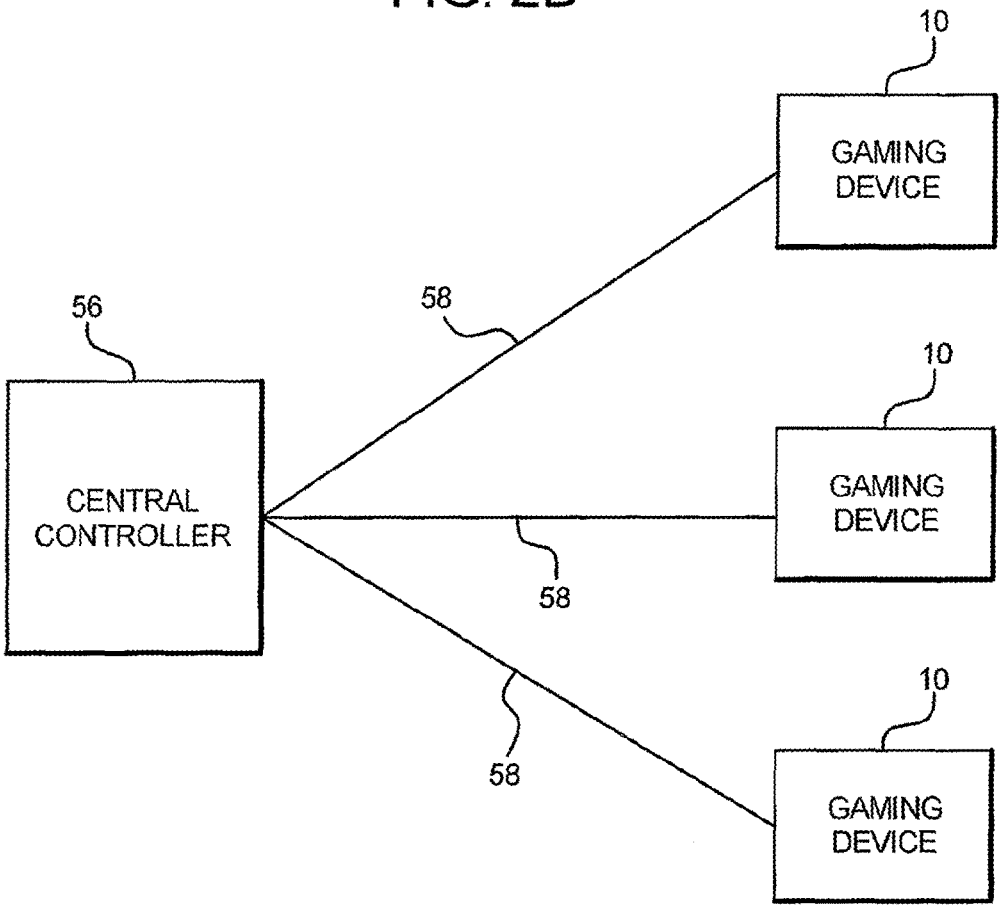
FIG. 2B is a schematic diagram of the central server in communication with a plurality of gaming machines in accordance with one embodiment of the gaming system disclosed herein.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Collection Games

Figure 3:
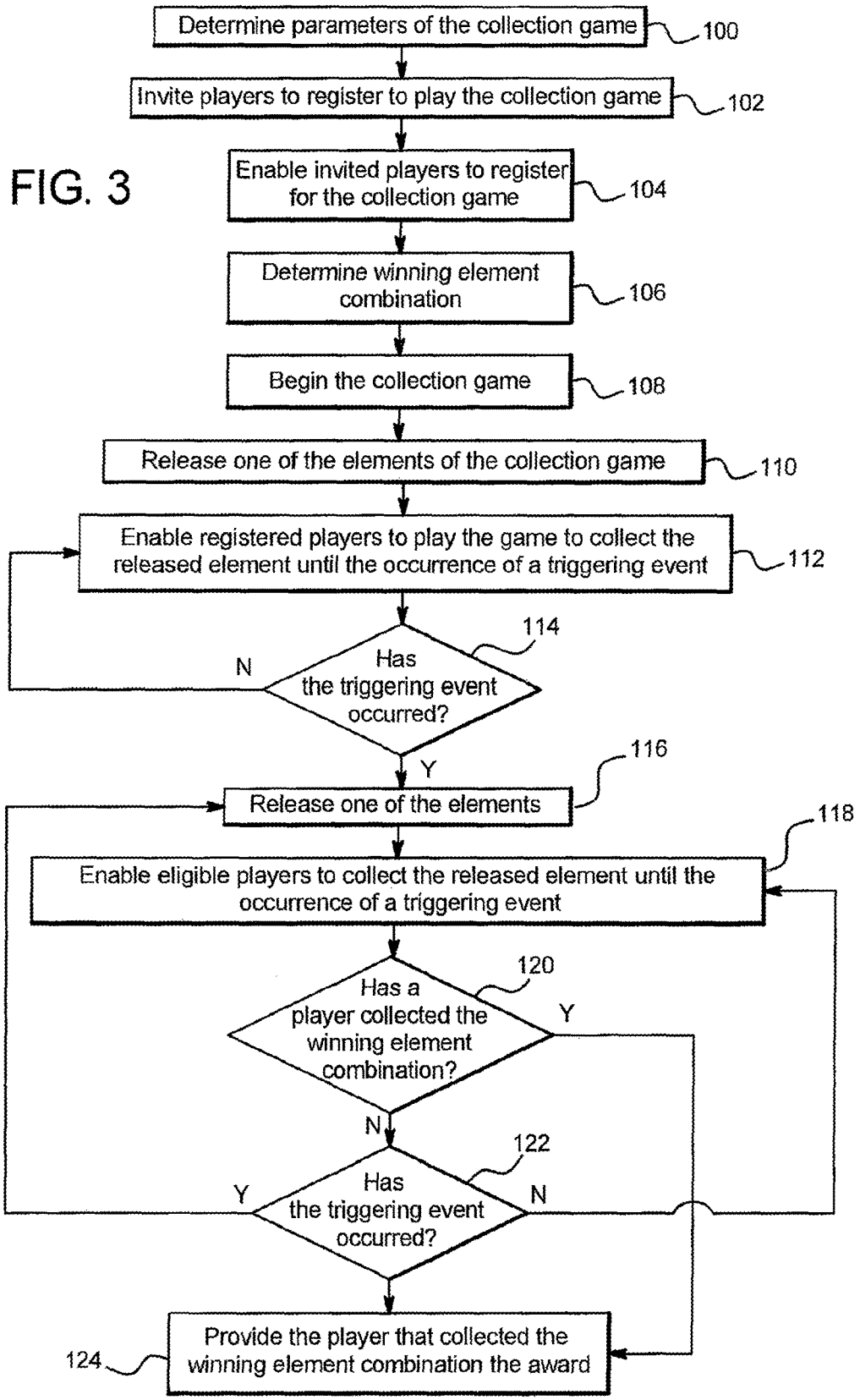
FIG. 3 is a flow chart illustrating one method of one embodiment of a collection game enabling qualified players to collect elements to try to collect a winning combination of elements.

FIG. 3 illustrates one embodiment of a collection game enabling qualified players to collect elements to try to collect a winning combination of elements. As illustrated in FIG. 3, in one embodiment, the gaming system determines the parameters of a collection game as illustrated in block 100. The gaming system or machines invite players to register to play the collection game as illustrated in block 102. The gaming system enables invited players to register for the collection game as illustrated in block 104. The gaming system determines a winning element combination as illustrated in block 106. It should be appreciated the winning element combination may be any suitable combination. As illustrated in block 108, the gaming system begins the collection game. For example, the gaming system enables players to enroll or otherwise be allowed to make inputs on a gaming machine to collect elements or to collect elements at a kiosk. As illustrated in block 110, the gaming system releases one of the elements of the collection game or provides a community award opportunity. As illustrated in blocks 112 and 114, the gaming system enables registered players to play the collection game and to collect the released element until an occurrence of a triggering event. After the gaming system determines that the triggering event has occurred, the gaming system releases a next or different one of the elements as illustrated in block 116. The gaming system then enables eligible players to collect the newly released element until the occurrence of a triggering event as illustrated in block 118. As illustrated in diamond 120, the gaming system determines if one of the players has collected the winning element combination. If one of the players has collected the winning element combination, the gaming system provides the player that collected the winning element combination an award as illustrated in block 124. In one embodiment, the gaming system indicates to the player that collected the winning element combination first that they win an award. If one of the players has not collected the winning element combination, the gaming system determines if there has been an occurrence of the triggering event as illustrated in diamond 122. If there has not been an occurrence of the triggering event, the gaming system continues to enable eligible players to collect the released element until the triggering event occurs as illustrated in block 118. The gaming system continues releasing elements and enabling the players to collect the elements until a player has collected the winning element combination.

It should be appreciated that the triggering event may be any suitable event. It should also be appreciated that the collection game may include one or more different triggering events. For example, one of the triggering events may be a passage of time and another one of the triggering events may be a certain number of players collecting a certain number of the elements or not collecting a certain number of the elements.

It should be appreciated that in various embodiments the collection game is independent of any results in the base game and any other bonus game of the gaming system. For example, in one embodiment, if a player is playing a slot game, the collection game and the triggering events are independent of the slot game. It should be appreciated that the collection game may be played over multiple plays of the base or primary game. It should also be appreciated that in different embodiments the player may move from gaming machine to gaming machine and continue play of the collection game after identifying himself or herself at the gaming machine. That is, the collection game provides enables players to play different gaming machines and continue play of the same collection game.

It should also be appreciated that if the player meets predefined criteria, the gaming system in various embodiments, enables the player to collect released elements in other ways than by play of a gaming device. For example, once a day the gaming system enables the player to collect a released element at a kiosk. In one embodiment, the gaming system enables one or more players to collect one or more elements using a cellular phone, blackberry or personal computing device. In another embodiment, the gaming system enables one or more players to collect one or more elements using the internet. In one embodiment, each player may collect a certain number of elements without using a gaming machine. In certain embodiments, the gaming system only enables certain players to collect one or more elements outside of the gaming establishment. For example, gold level players may collect two elements via the internet but other level players have to collect all of the elements inside the hosting gaming establishment.

Figure 4A:
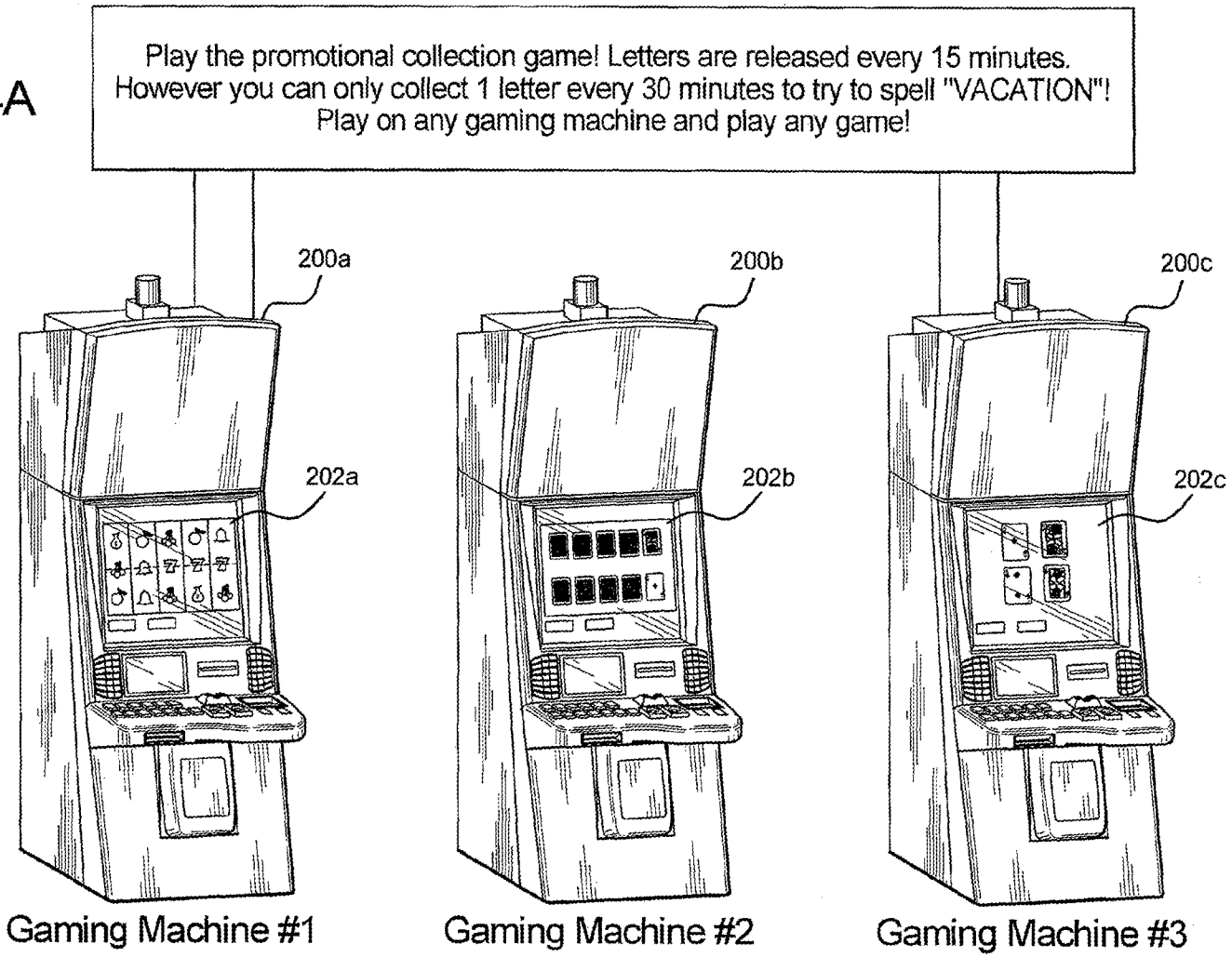
FIG. 4A is a gaming system illustrating the parameters of a collection game.

FIGS. 4A, 4B, 4C, 4D, 4E, 4F, 4G and 4H illustrate one embodiment of a plurality of gaming machines enabling players to play a collection game while playing a plurality of different types of base or primary games. As illustrated in FIG. 4A, a plurality of gaming machines 200*a*, 200*b* and 200*c* include a plurality of different primary games. For example, the first gaming machine 200*a* displays a primary slot game on a display device 202*a*. The second gaming machine 200*b* displays a poker game on a display device 202*b*. The third gaming machine 200*c* displays a primary blackjack game on a display device 202*c*. As illustrated in FIG. 4A the gaming system informs the player that they can play a promotional collection where game letters are released every fifteen minutes with the goal of spelling the word "vacation." Each of the players may only collect one letter every thirty minutes to try to spell the word "VACATION." The gaming system in one embodiment enables the players to play on any gaming machine and play any type of primary game. Therefore, in one embodiment the collection or persistence game is a time based game that is independent and separate from any of the primary games.

Figure 4B:
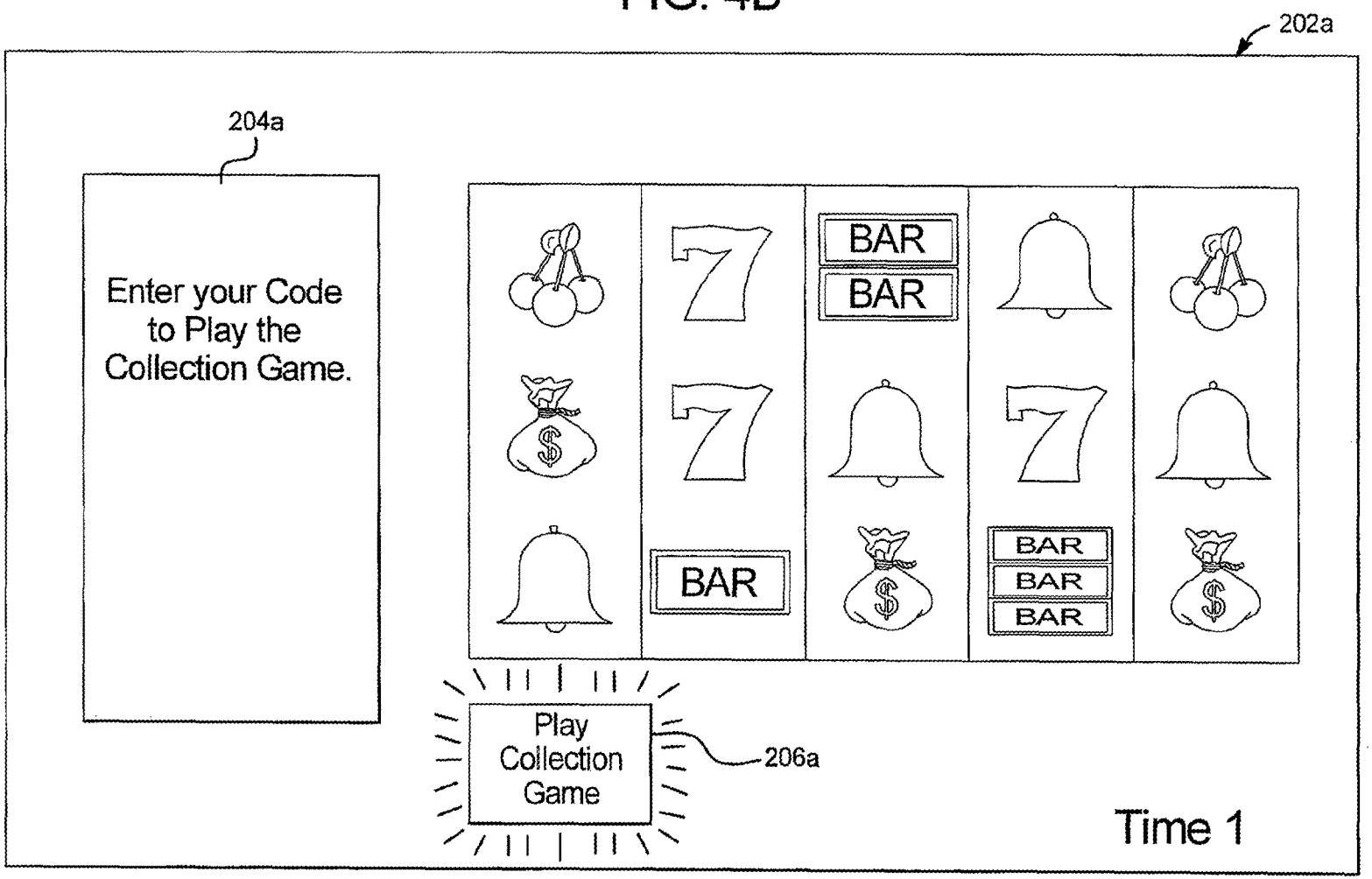
FIGS. 4B, 4C, 4D, 4E, 4F, 4G, and 4H are screen shots of the gaming machines of FIG. 4A illustrating each of the gaming machines participating in the collection game at a same point in time.

FIGS. 4B, 4C, 4D, 4E, 4F, 4G and 4H are screen shots of the first, second and third gaming machines at a same time period illustrating the collection games of different individual points in the game. FIG. 4B, illustrates a screen shot of the display device 202*a* of the first gaming machine 200*a*. In this example the display device displays a service window 204*a* and displays a collection game button 206*a*. It should be appreciated the collection game may be played in any suitable manner. The service window 204*a* instructs the player to enter a code to play the collection game. Therefore, before playing the collection game in one embodiment, the player must be registered and been invited to play the collection game. In one embodiment upon registration, the gaming system provides the player a code to enter at a gaming machine to play the collection game once the collection game has started. In one embodiment, the player enters their code to play the collection game (not illustrated).

Figure 4C:
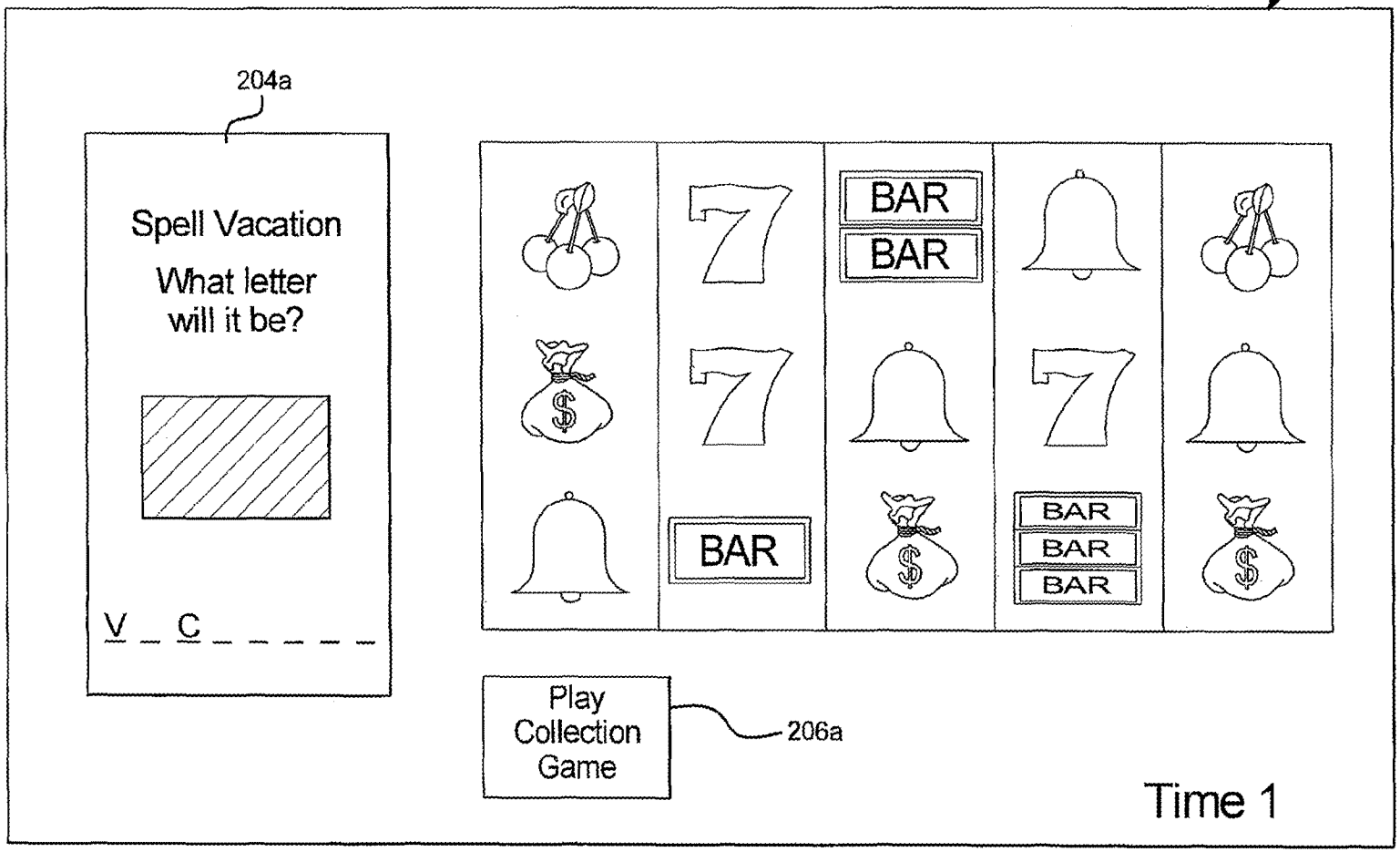
Figure 4D:
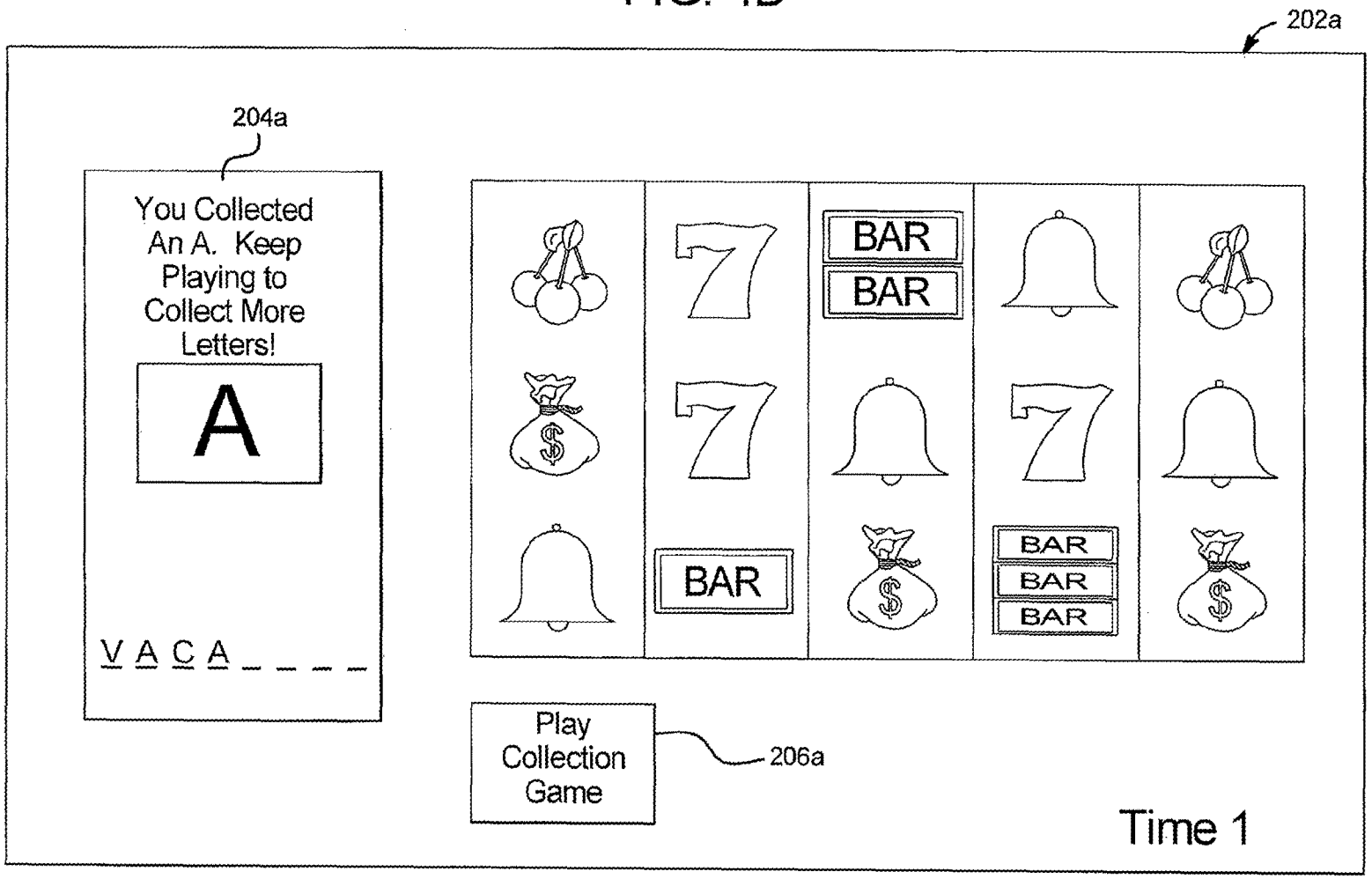

As illustrated in FIG. 4C, the gaming system informs the player the goal is to spell the word "VACATION." As illustrated in FIG. 4C, the gaming machine is going to reveal one of the letters of the collection game. As illustrated in FIG. 4C, the player playing at the first gaming machine already has collected the letters "v" and "c" as displayed in the service window. As illustrated in FIG. 4D, the gaming machine reveals the letter "a" and informs the player that they collected the letter "a." The gaming machine fills in the "a's" of the word "VACATION." The player of the first gaming machine now has the letters "v", "a", "c", "a" and still needs the letters "t", "i", "o", "n" to win the game. Therefore, the player must keep playing and remain in the gaming establishment to collect the letters every thirty minutes to try to obtain the letters t, i, o, and n.

Figure 4E:
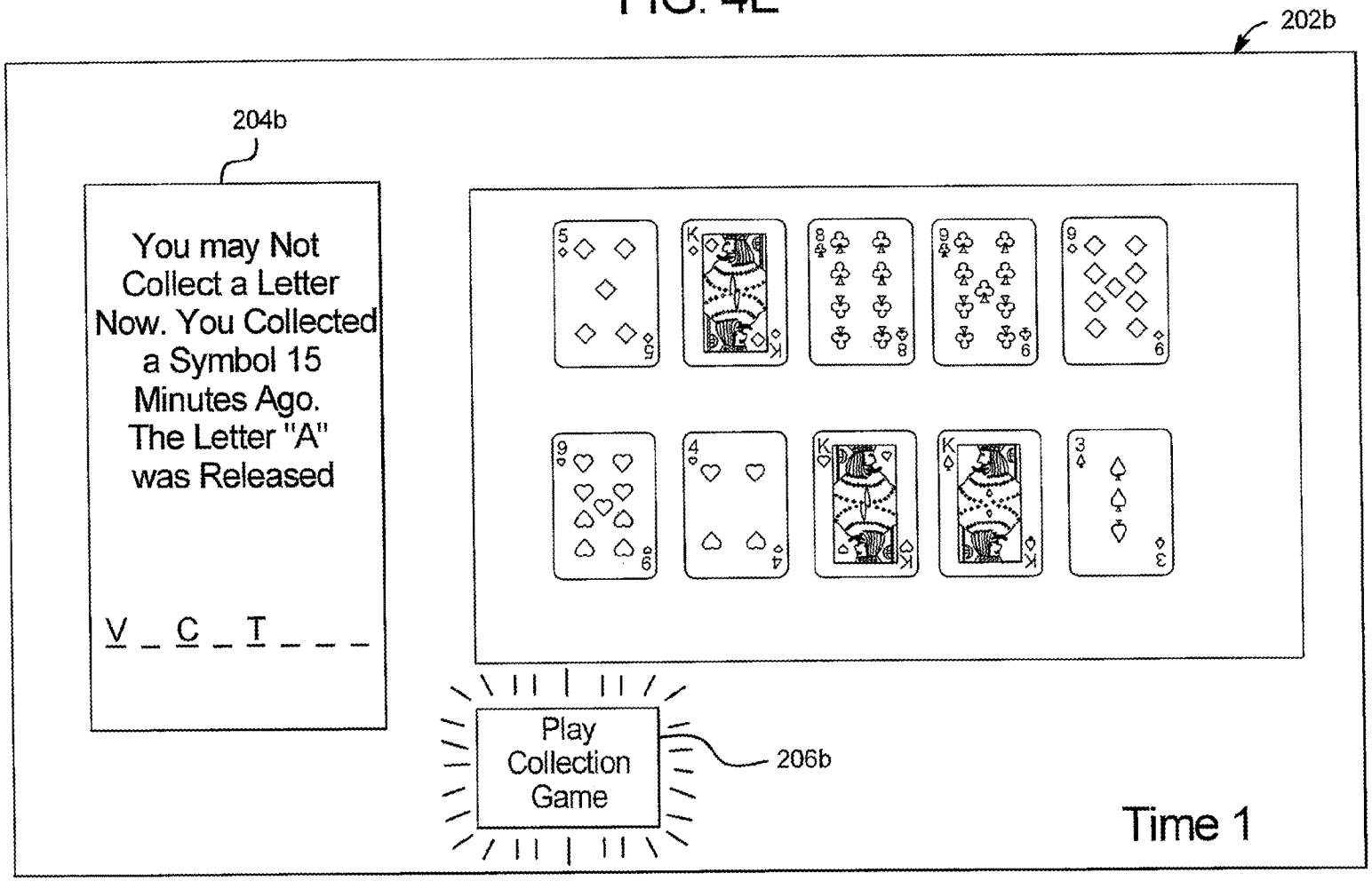

FIG. 4E illustrates a screen shot of the display device 202*b* of the second gaming machine 200*b*. The player playing the second gaming machine has collected the letter "v", "c" and "t." The gaming system releases a letter and the player at the second gaming machine presses the play collection game button 204*b* to try to collect the next letter.

Unfortunately, for that player, they collected one of the letters 15 minutes ago and therefore may not collect a letter until 15 more minutes have passed. In one embodiment, the gaming system informs the player of the released, uncollected letter. As illustrated in FIG. 4E, the gaming machine informs the player that the letter "a" was released. The player at the second gaming machine will be able to collect the next released letter in 15 minutes. The player at the first gaming machine may not collect the next released letter, but must wait 30 minutes to collect another letter. This configuration adds a level of interest to the collection game for players.

Figure 4F:
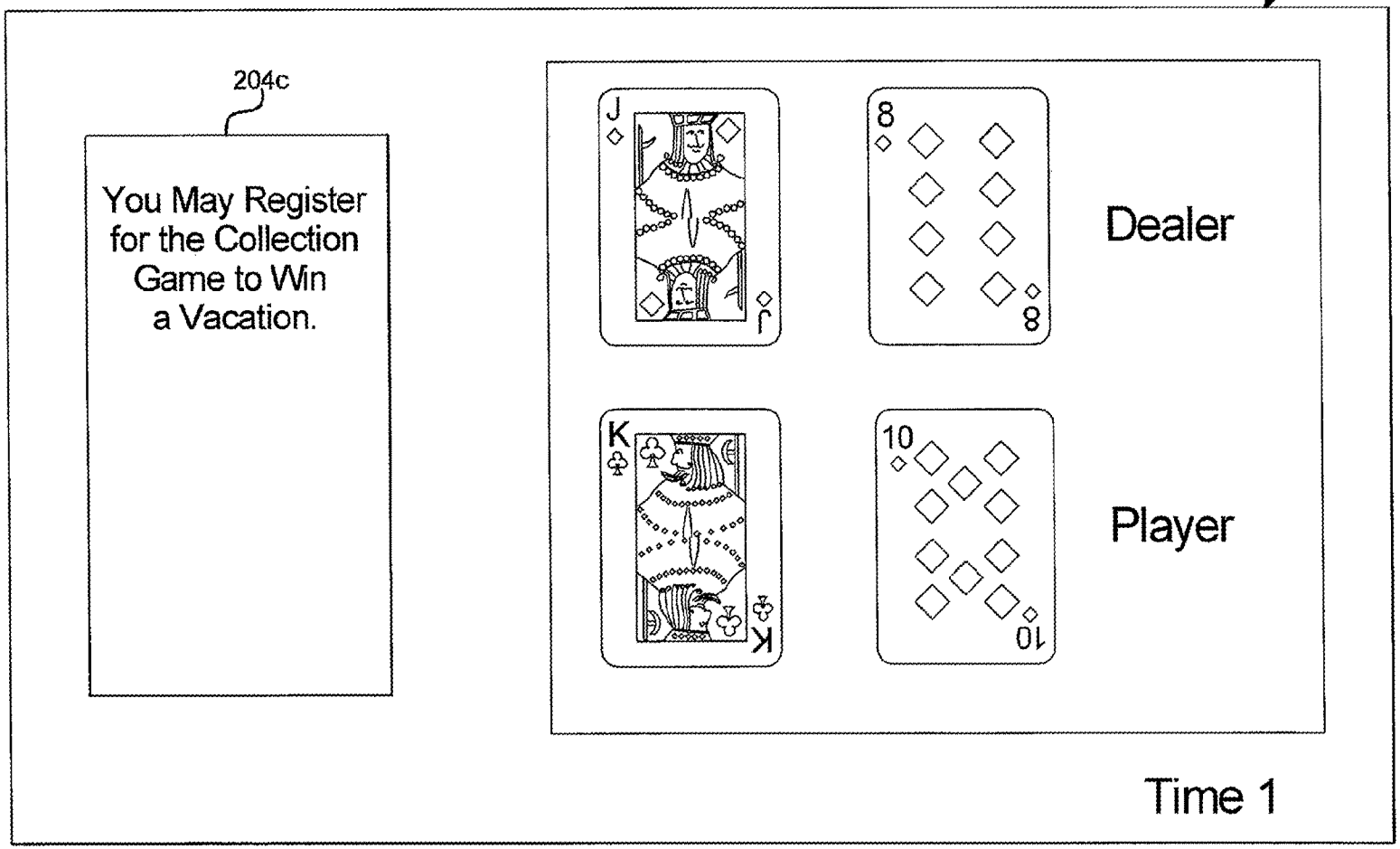
Figure 4G:
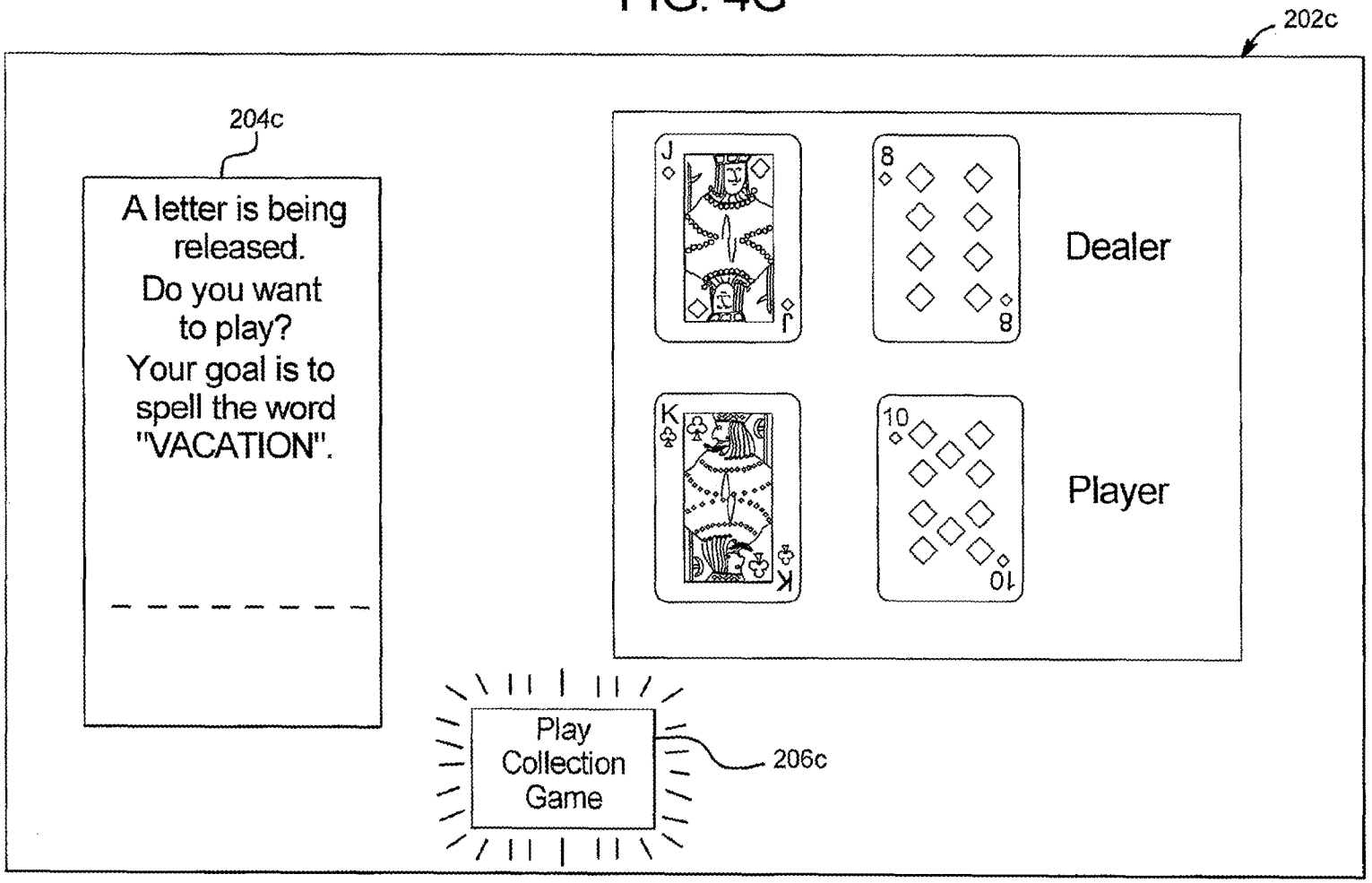
Figure 4H:
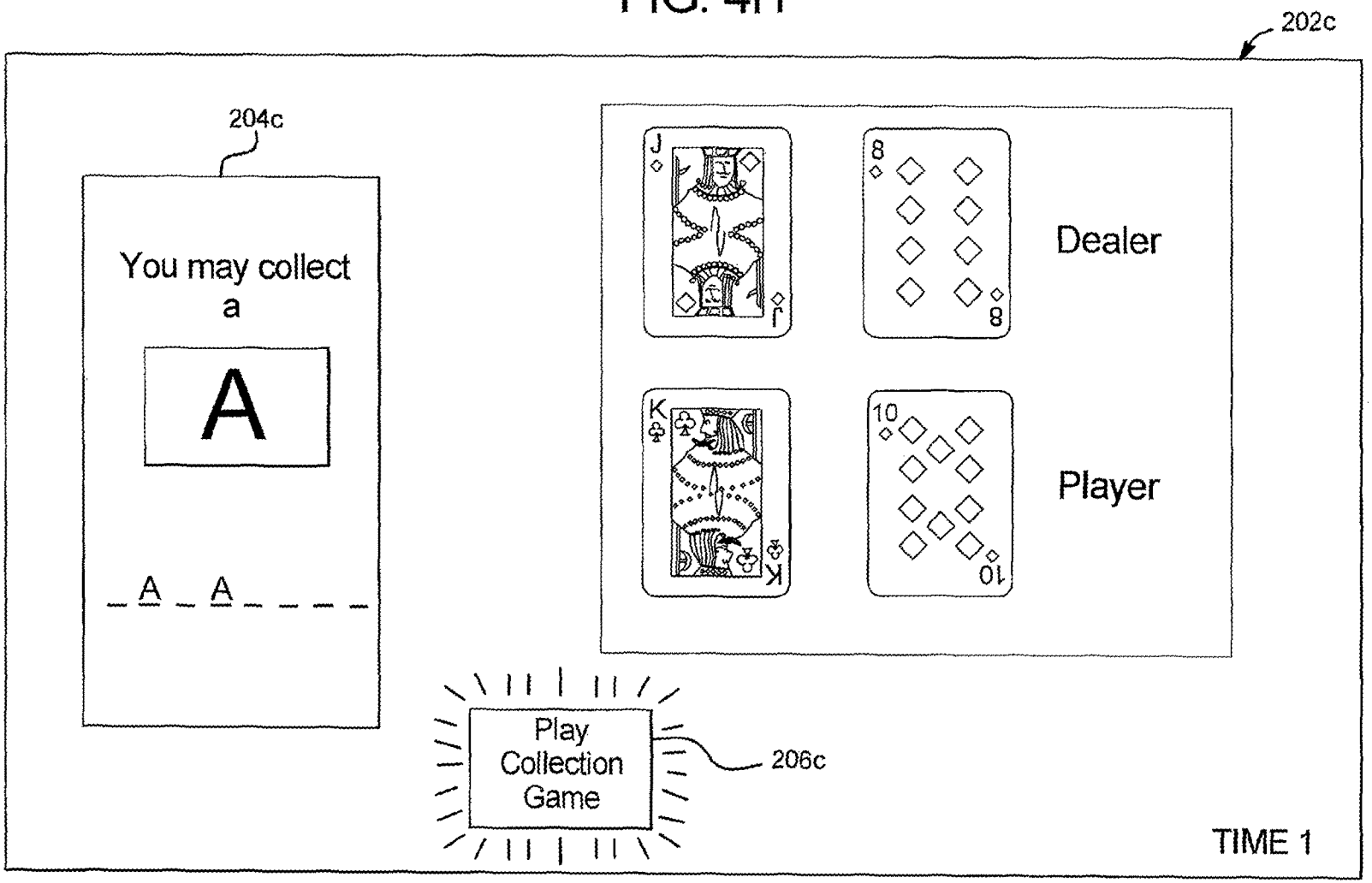

FIG. 4F is a screen shot of the display device 202*c* of the third gaming machine of the third gaming machine 200*c*. In one embodiment, the gaming machine enables the player to register for the collection game at that gaming machine. As illustrated in FIG. 4F, the gaming system informs the player that they may register to play the collection game to win a vacation. As illustrated in FIG. 4G, the gaming machine informs the player that a letter is being released. The gaming system asks the player if the player wants to play and informs the player that their goal is spell the word "VACATION." As illustrated in FIG. 4G, the player presses the play collection game button 206*c* as an indication that they want to play the collection game. As illustrated in FIG. 4H, the gaming machine reveals an "a" as the letter to be collected. The gaming machine informs the player that the player collects an "a" and fills in the letter "a" in their word puzzle.

The game continues (not illustrated) until one of the players obtains all of the elements in the winning element combination or winning element combination. In one embodiment, the elements do not have to be collected in the order of the winning combination. That is, it does not matter if the player collects the "n" in vacation before the "v" in vacation. In another embodiment, the player must collect the elements in the order of the winning element combination. This embodiment makes the game even more interesting.

In one embodiment, if an element is repeated in a winning element combination, the released element may only be used once per release of that element. For example, if the winning element combination is "vacation" the first time the letter "a" is released it is used to fill in one of the "a's." The player must wait for another letter "a" to be released to fill the other "a." In one embodiment, some players may use a released element more than once in a winning element combination. For example, all players who wagered $100 or more in the past hour, may use released elements multiple times in the next hour. All players who wagered less than $100 or less in the past hour, may use released elements only a single time in a winning element combination. In another example, players of a certain player rank may use released elements multiple times in a winning element combination while players of lower player ranks may only use released elements a lower number of times in a winning element combination than the players with a higher player rank.

In one embodiment, the sequence or order of the elements is determined or locked in before the beginning of the collection game. That is, before the collection game begins, the elements are locked in a predetermined order to be released to the players. For example, the elements may be released in an offset cycle and a predetermined sequence that is locked in the moment that the collection game begins. For example, as illustrated in FIGS. 4A through 4H, if the player is trying to spell the word vacation and the collection game begins 8:00 a.m. on the first day of the month, the sequence that the elements will be released is locked in at that point in time and repeats itself in an offset manner to make the players unaware of when a specific element will become available. In the above example, the new element became available every 15 minutes but the player was only allowed to collect an element every 30 minutes. It should be appreciated that the time in between releasing the elements may be any suitable time period. It should also be appreciated that the time period does not have to be a set time period but may be a variable time period so that players are more interested and do not know when to report to the gaming establishment and therefore remain in the gaming establishment waiting for the elements to be released. Additionally, in the above example, the player is only allowed to collect one of the elements every 30 minutes. It should be appreciated, that the players may collect the elements or symbols in any suitable time period and this time period may vary or be dependent on the time period release of the elements. In the above example, in one embodiment the same element would repeat itself a couple of times per day but at different times each day. Therefore, with constant monitoring a player may be able to figure out the sequence and can anticipate the elements that will need to be available. In another embodiment, upon cycling through each of the elements of the first predetermined sequence, the gaming system begins another, different predetermined sequence such that the players cannot determine when an element will be released. That is, the gaming system has a plurality of predetermined element sequences which may be different in any suitable manner. It should also be appreciated that elements not needed for the winning combination may be released in certain embodiments.

For example, if the elements are the 26 letters of the alphabet and the player is required to spell the word "VACATION" and the letters are released every thirty minutes, the 26 letters of the alphabet would repeat every 6.5 hours until all of the letters are collected if none of the letters are repeated in the predetermined sequence. However, if more than one of the letters is repeated in the predetermined sequence, the player may have a harder time figuring out when the gaming system releases all of the elements of a first sequence. The gaming system begins releasing the elements of a second sequence. Additionally, if there is more than one predetermined sequence, meaning that after the cycling of one predetermined sequence the next cycling would include the same elements but just be in a different order, one or more elements will be in a different order, the players will not be able to readily or easily figure out when elements will be released. This adds further randomness to the collection game of the present disclosure.

In different embodiments, the gaming system only enables players to collect an element for a limited time period or until an occurrence of one or more triggering events.

In one embodiment, the gaming system enables the player to determine whether or not to collect the released elements. For example, in one embodiment the released element is presented or displayed to the player and the player determines if they want to collect or not collect that element based on the winning element combination. In another embodiment, the gaming system enables a player to determine if they are going to collect an element or not, but does not show the player the element. Therefore, it is advantageous for the player to spend the time watching what elements were previously released to better determine whether to collect the next element or not. For example, if the winning element combination are the numbers or elements 2 1 9 8 3 and each of the elements can only be drawn a single time in a single cycle, and the elements range from 1 to 10 inclusively and elements 1 to 8 have been released and 9 and 10 have not been released, the gaming system has a 50 percent chance of releasing the 9 in the winning element combination. However, if the numbers left to be released are 7, 6, 5, 4 and 1, the gaming system has a much lower chance of releasing the 1 the player needs to complete the symbol combination and may wait and see if one of the other symbols will be released. Therefore, the player makes decisions on which letters to collect to try to win the game.

It should be appreciated that the player may collect the elements in any suitable manner. In one embodiment, the player must be playing at a gaming machine and identify his or herself at a gaming machine such as by entering a promotional code, inserting an ID number or inserting a player tracking card, so the gaming machine can identify the player. In other embodiments, player may enroll at a kiosk or go to a promotional desk to collect the released elements. In other embodiments, the gaming system may use other methods such as biometric identification or RFID devices to identify the player.

It should be appreciated that any suitable number of elements may be released simultaneously. It should also be appreciated that the gaming system may enable one, a plurality or all of the participating players to collect one, a plurality or all of the simultaneously released elements. For example, the gaming system releases three elements and enables each player to collect every released element. In another example, the gaming system determines the number of released elements to enable a player to collect based on any suitable factor, such as coin-in, player card ranking, or length of play of the collection game. In one embodiment, where the player may simultaneously collect more than one released element, the gaming system assigns certain of the released elements to the player. In one embodiment, where the player may simultaneously collect more than one released element, the gaming system enables the player to choose which released elements to collect.

It should be appreciated that players may qualify or be eligible to play the collection game for any suitable reason. In one embodiment, eligibility is determined by the player card status. For example, players who have gold card status are always invited to participate in the collection games or the persistence games. In another embodiment, the most recent players who have identified themselves at the gaming establishment are invited. In another embodiment, the gaming establishment invites a plurality of different types of players to play in the collection game, such as players who used to be regular customers and have not been gambling as frequently and some players who have recently and frequently played at the gaming establishment. It should be appreciated that players may be eligible to play the collection game based on any suitable parameters. In one embodiment, if a gaming establishment is affiliated with a hotel, the gaming establishment may invite all players who are staying at the hotel to participate in the collection game for the weekend. It should be appreciated that a gaming establishment may invite players to participate in the collection game for any suitable reason.

It should be appreciated that the gaming establishment may invite players to participate in the collection game in any suitable manner. In one embodiment, the gaming establishment emails all eligible players. In another embodiment, the gaming establishment calls all eligible players to ask them personally to participate in the collection game. In another embodiment, the gaming establishment invites players to participate in the collection game via the postal mail, text messaging or fax machines. In other embodiments, automatic communications can be sent to player devices such as cellular telephones, home telephones or email addresses. It should be appreciated that the gaming establishment may invite players to participate in the collection game via any suitable method.

It should be appreciated that players may register to play the collection game in any suitable manner. In one embodiment, the players use the gaming establishment website to create a profile to sign up for the current collection game. In another embodiment, the gaming establishment enables players to sign up for collection games at the gaming establishment. In another embodiment, the gaming system enables the player to register and/or invites the player to play while the player is playing at a gaming machine. In another embodiment, the gaming system enables the player to register for the collection game at a kiosk. In another embodiment, the gaming system enables the player to register by inserting a player tracking card. In another embodiment, the gaming system enables the player to register using biometric information. It should be appreciated that the player may register for the collection game in any suitable manner.

Once a player registers, the gaming system may provide the player and suitable identification to begin play of the collection game upon start of the collection game. For example, in one embodiment, the players are given a code to input at a gaming machine to enable the players to play the collection game. In another embodiment, once after the player registers, the player inserts their player tracking card into the gaming machine to identify themselves to play the collection game at that gaming machine.

In various embodiments, a player must be actively playing a gaming machine to collect an element or to participate in the collection game. In one such embodiment, a gaming device (or a player currently at the gaming device) is active if the gaming device is being actively played by a player during a designated period. The active status requirements can be based on any suitable number of satisfied criteria or defined in any suitable manner by the implementer of the gaming system. For instance, a play of or wager on the primary game of the gaming device within a predetermined period of time may be part of the determination of whether that gaming device (or the player currently at that gaming device) is in the active status. Other factors such as: (a) the amount of time between each play of or wager on the primary game of the gaming device; (b) the amount being wagered on the primary game(s); (c) the number of plays within a period of time, and (d) the existence of credits on the gaming device may also or alternatively be part of the determination of whether a gaming device (or the player currently at that gaming device) is in the active status. On the other hand, inactive status means that the gaming device is one of the gaming devices in the gaming system, but is not in the active status (i.e., not being actively played by a player according to one or more of the predetermined criteria) during the designated period.

The gaming establishment may promote or advertise the collection game or persistence game in any suitable manner. In different embodiments, the gaming establishment website highlights current promotions and what prizes are currently being given away to inform players of what they can try to register for, how to be invited to play, the rules of the collection game and other suitable information. Players will be able to see which elements they have accumulated and which elements they still need to acquire. In one embodiment, the gaming establishment also advertises prize schedules coming up in the future promotions on their website so that the players may plan trips to go visit that gaming establishment. In one embodiment, after a player has registered and the collection game has begun, the player may track their progress of the current game on the gaming establishment website or any participating gaming machine or kiosk. This enables players to see which elements they have to collect and which elements they need to acquire. In certain embodiments, which elements have already been released may also be included on the website or indicated to the player at the gaming machine. It should be appreciated that in certain embodiments players may not acquire or collect any new elements from the website. In certain embodiments, the players may only obtain and collect the elements while playing at a gaming machine of the gaming establishment. In another embodiment, the players may obtain or collect the elements while in the gaming establishment. In one embodiment, the gaming system text messages or emails players regarding the element releases. For example, the gaming system text messages all participating players that are not actively playing gaming machines when an element is going to be released to provide the players time or an indication to go to the gaming establishment to collect an element. The gaming system may or may not inform players which element will be released.

Once a player obtains the winning element combination, in one embodiment, the player must visit a promotions kiosk or counter to print out their winning ticket with a barcode on it to redeem the prize for the collection game. In another embodiment, the gaming system enables a player to print off a ticket at a gaming machine. In another embodiment, the gaming establishment immediately credits the player's account or the gaming machine for a monetary value.

It should be appreciated that the number of elements that need to be collected may vary depending on the value of the prize given. For example, the higher the value a prize has, the harder it may be to acquire all of the elements needed to win. It should also be appreciated that the order and repetition of certain of the elements in a sequence may vary depending on the value of the prize. For example, the higher the value of the prize, the harder it will be to acquire all the elements needed to win the combination. By increasing the number of elements needed to win, the gaming establishment increases the amount of visits and time the players will need to play to win. Alternatively, the gaming establishment can make a specific letter available on a limited basis. For example, if the player had to spell "PLASMA" to win a plasma television, the gaming system could make the letters P, L, A, S, available on a rotating basis, but make the letter M available only once every day. Thus, a player's timing is crucial to obtaining the M. By increasing the time it takes to obtain one or more elements or increasing number of elements needed to win, the gaming establishment increases the amount of visits and the time players will need to spend at that gaming establishment to win the game.

In one embodiment, the elements are released in different orders for different players. For example, a first player has a first order of elements released and a competing second player has a second order of the same elements released. In another embodiment, the gaming system determines a plurality of different orders to release the elements. Each order is used for a single group of players and different orders are used for the different groups of players. For example, platinum level player card players have a first order of released elements and gold level player card players have a second order of released elements. In another example, one or more orders of elements are determined based on the value of the award given.

It should be appreciated that in the event that the player misses the release of an element in one embodiment they have to wait a full cycle before the element becomes released again. The collection game gives players awards for playing in the gaming establishment longer to win prizes over time. The basis of the game will enable the gaming establishment to give away selected prizes for collection promotion that could a short time period, such as a couple of hours or a longer time period, such as a long weekend, depending on the value of the prize to players.

It should be appreciated that the elements may be weighted in the order of release in any suitable manner. In one embodiment, many of the elements are weighted differently to change the odds of obtaining the winning element combination. For example, one symbol may appear five times in the order of release before another symbol appears even once. In another embodiment the elements are randomly generated by the gaming system. In one such embodiment, the elements are weighted then randomly generated is based on the weights or probabilities of being generated.

It should be appreciated that the elements may be any suitable elements. In one embodiment, the elements are letters and the players must spell a word. In another embodiment, the elements are numbers and the player must collect a numerical combination. In another embodiment, the elements are one or more symbols on cards. For example, the players may be required to obtain a royal flush to win the collection game. In another embodiment, the elements are astrological signs. In one embodiment, the winning element combination is all of the astrological signs. In another embodiment, the elements are parts of a board game. In another embodiment, the elements are puzzle pieces.

It should be appreciated that the elements may be presented to the players in any suitable manner. In one embodiment, the element is presented to the player as the element is released. The player then may automatically collect or make an input to collect the element. In another embodiment, the gaming system enables the player to play a short game to reveal the released element. For example, the gaming machine may display a plurality of different elements rotating and then stop on the released element. In one such embodiment, the sequence for the game to reveal the symbol is a non-interactive game. That is, the player watches as the symbol is presented to them. In another embodiment, the gaming system releases a plurality of elements. In one such embodiment, the gaming system enables the player to actively select which element the player wants to collect. For example, in a collection card game, the gaming system releases a pair of card are presented to the player. For example, five cards from a deck are released and presented to the player. The goal in the card game is to obtain a straight. The gaming system then enables the player to select a card to collect from the plurality of cards that are presented to the player. For example, the cards may be face down or face up and if the player selects the card that would better their chances of obtaining a straight based on their other collected cards. In another embodiment, the cards are face down and player randomly selects the card from a plurality of cards and then the player collects that card.

It should be appreciated that any suitable number of the elements may be released at the same time in any suitable manner. In one embodiment, the player may collect all of the released elements. In another embodiment, the player may have to participate in a game such as a skill game to determine how many of the released elements that the player will able to collect. These different embodiments of enabling the player to determine which symbols to collect enables the game to be more challenging and exciting for players.

In one embodiment, a collection game button or input is not active until the player is eligible to try to win or try to collect one of the released elements. In another embodiment, the collection game button or input is inactive in between times that the player is eligible to collect an element, such as when a player has already selected an element is not able to select another element.

Various embodiments of the present disclosure may produce collaboration and companionship among participants. Players can be encouraged to work in teams, asking each other what element is currently active, or to try to collaboratively figure out which symbol will be up next. This allows players to have at least a perceived advantage by working together, if not an actual advantage. For example, if Player A and Player B are married and both are trying to complete the element combination of "sound system," they can work together to help each other try to win the prize. For example, if Player A does not need an S and Player B inputs their code and got an S, Player B may let Player A know so that they can wait until a next cycle to try for a different letter. This setup may make Player A and B feel as though they have an informational advantage and thus encourages them to continue to play to try and collect more elements as they feel they have an edge by working together. Collaboration may make players likely to continue to try to win and thus continue play on the gaming machines.

In one embodiment, the gaming system includes a collection game chat on the gaming machines that enables players to chat with other collection game players in their service window to further add collaboration throughout the gaming establishment. Often, players who come together may not like the same type of games and this allows them to play the games what they want, but still stay in contact with their friends regarding the collection game.

It should be appreciated that the collection game may reset in any suitable manner. In one embodiment, when a player wins the collection game, the collection game resets for all players playing the collection game. For example, the award is a large single award that is awarded to the first person to collect the winning element combination. When a player collects the winning element combination, that collection game is over and a new collection game begins. In another embodiment, when a player collects the winning element combination, the game continues for every other non-winning player until a designated number of players wins the collection game. The awards may be the same or different for each players. For example, the first player to collect the winning element combination wins two free hotel room nights and the second player to collect the winning element combination wins one free hotel mom night. In another embodiment, the gaming system provides a plurality or every participating player wins an award. For example, all players that participated in the collection game for more than three hours wins an award.

It should be appreciated that the collection game may be funded in any suitable manner. In one embodiment, the collection game is funded by a portion or a percentage of participating wagers. In another embodiment, the gaming system requires the players to pay an entry fee to play in the collection game. In another embodiment, the gaming system funds the collection game with marketing dollars.

In another embodiment, the collection or persistence game includes one or more game boards or cards that are provided to the player upon registration for the collection game. Each player is assigned a new game board at the beginning of each collection game. In one embodiment, the game board is an electronic game board that the gaming machine displays once a player identifies himself or herself on one of the gaming machines during the collection game. This collection game enables a gaming establishment to provide players the prizes over the period of days or weeks depending on the value of the prize to the players that obtained the correct element combinations or element pattern on the cards.

Figure 5:
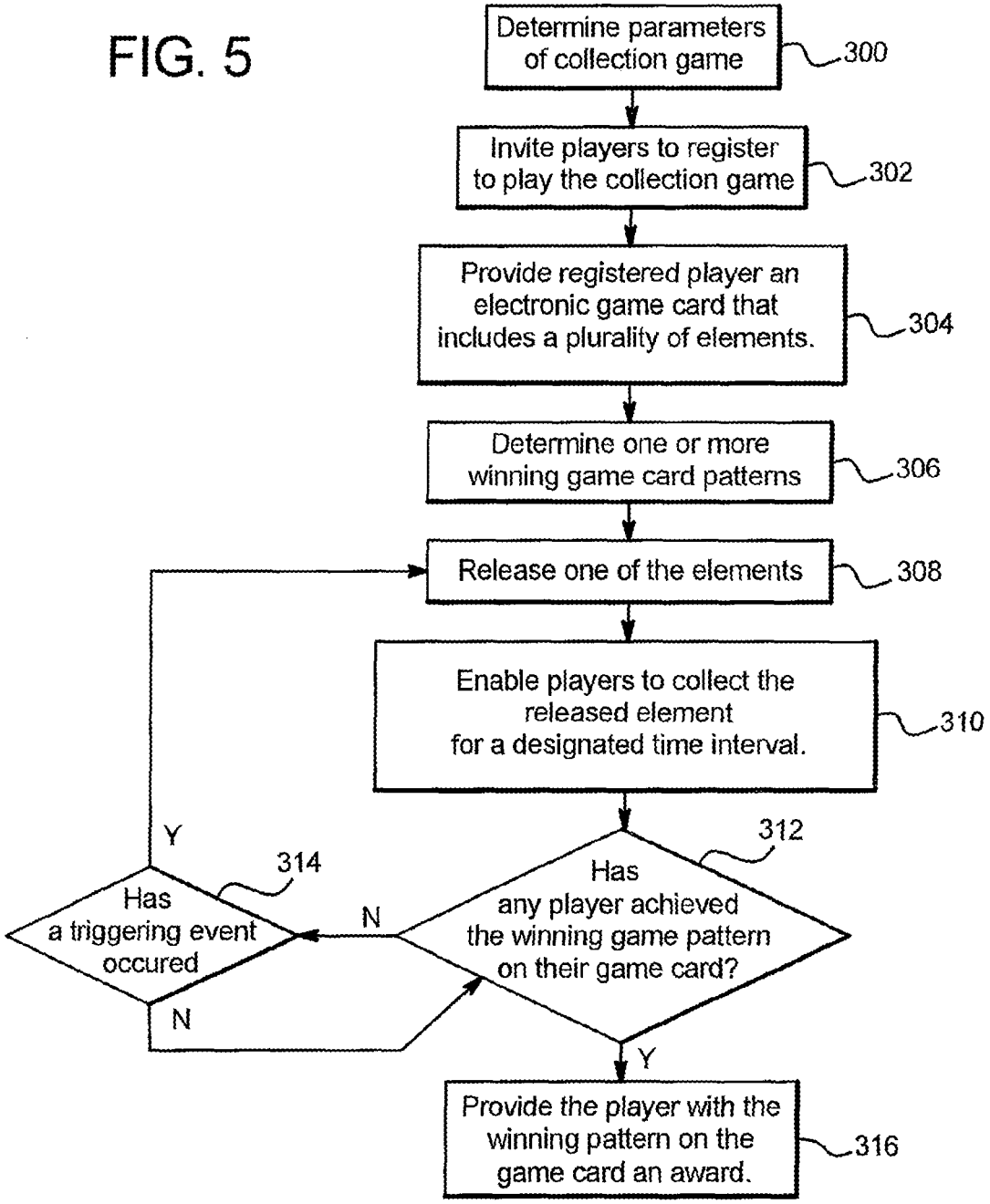
FIG. 5 is a flow chart illustrating one method of one embodiment of a collection game enabling qualified players to collect elements on a game board to try to collect a winning element pattern on the game board.

As illustrated in FIG. 5, the gaming system determines the parameters of the collection game as illustrated in block 300. The gaming establishment invites players to register to play the collection game as illustrated in block 302. The gaming system provides registered players an electronic game card that includes a plurality of elements as illustrated in block 304. The gaming system determines one or more winning game card patterns as illustrated in block 306. At the beginning or start of the collection game, the gaming system releases one of the elements. It should be appreciated that the gaming system may release any suitable number of elements in a single period of time. As illustrated in block 310, in one embodiment the gaming system enables the player to collect the released element for a designated interval of time. If that element is included on the player's game card, that element is marked on that game card. As illustrated in diamond 312, the gaming system determines if any player has achieved the winning game card pattern on their game card. If no one has achieved or collected the winning game card pattern on their game card, the gaming system determines if there is an occurrence of a triggering event as illustrated in diamond 314. If there is an occurrence of the triggering event, such as a passage of time, the gaming systems releases another one of the elements as illustrated in block 308. The gaming system then enables the player to collect that released element for a designated time interval on that player's game card as illustrated in block 312. The gaming system again determines if any player achieved the winning game card pattern on their game card as illustrated in diamond 312. If one of the players has achieved the winning game card pattern, the game ends and the gaming system provides the player with the winning game card pattern an award or prize. It should be appreciated that the winning game card pattern may be any suitable pattern.

Figure 6A:
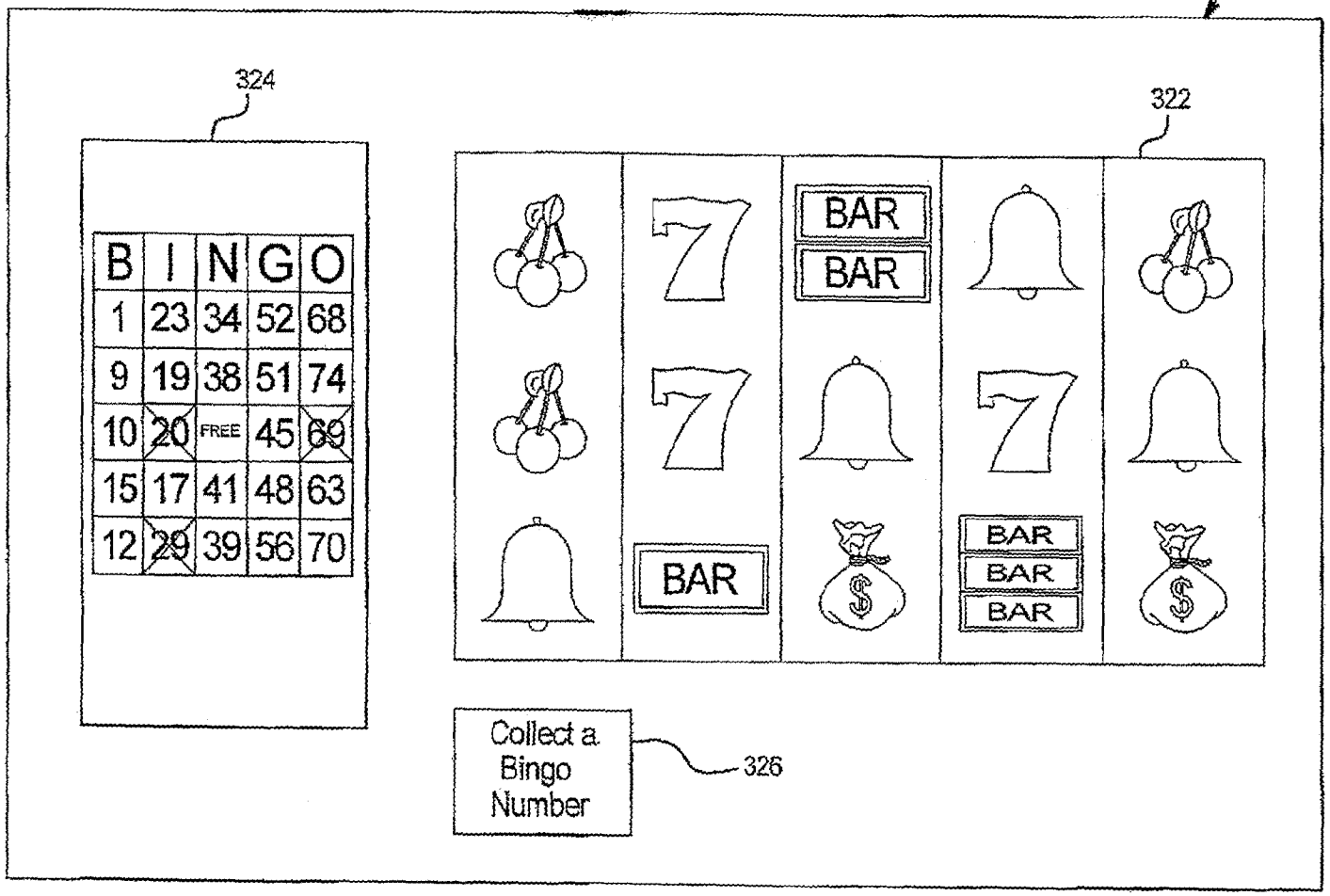
FIGS. 6A and 6B are screen shots of a gaming machine illustrating a collection game including a bingo game board.
Figure 6B:
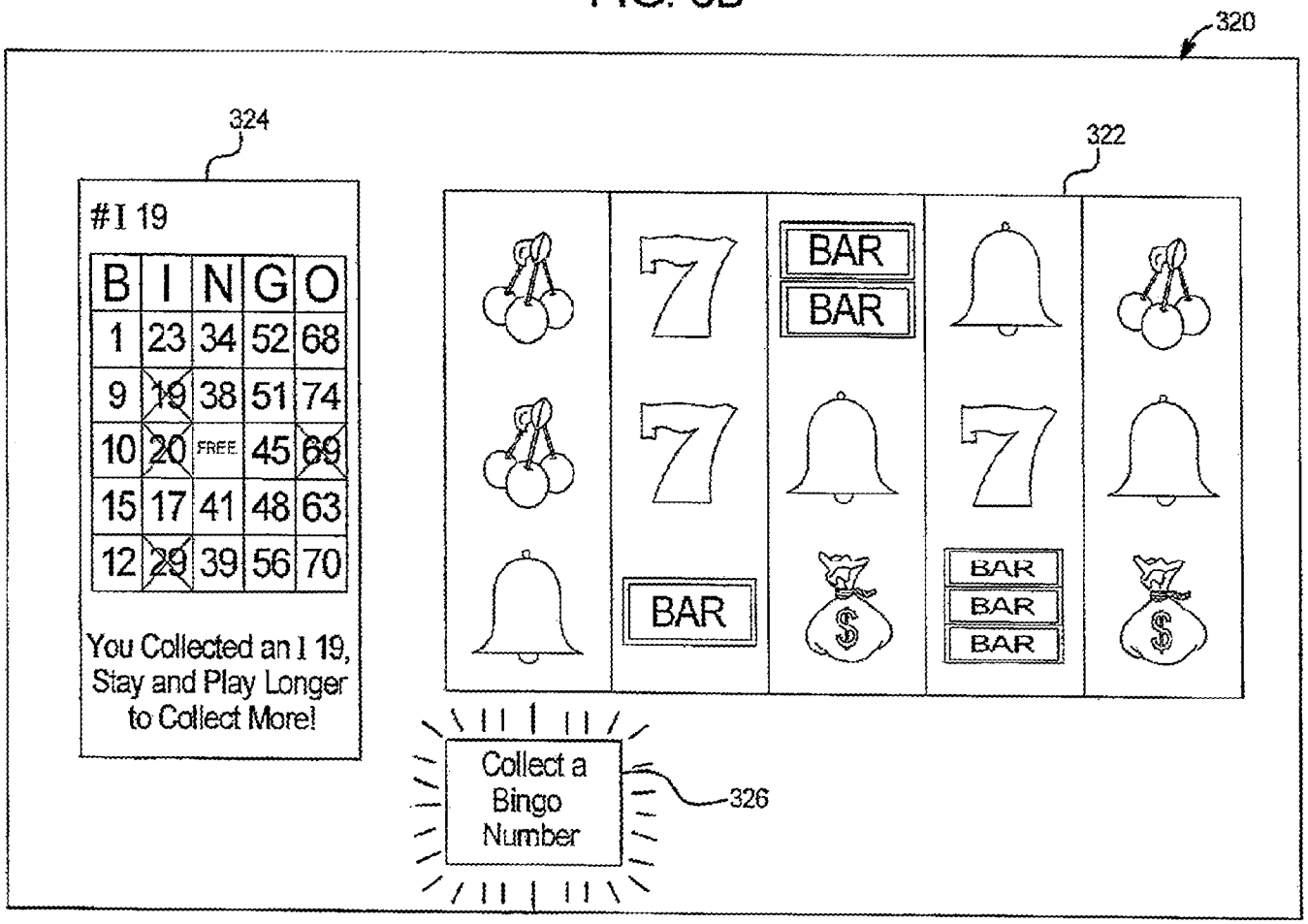

As illustrated in FIGS. 6A and 6B, in one embodiment, the game card is a bingo card which has a matrix or an array of elements such as letters and numbers. It should be appreciated in one embodiment that each different bingo card includes a different combination of elements. For example, four bingo cards are provided to four players and a same element may be present on all four of the bingo cards while another element may only be present on one of the bingo cards. It should also be appreciated that the elements may be placed in different locations on the bingo card. At the beginning of the game, the gaming system selectively draws one letter/element (letter and number combination) at a time. As each element is selected, the determination is made for each active participating gaming machine whether the selected element is present on the bingo card. In one embodiment, this determination is made by the central controller. The selected element present on that bingo card, that selected element of that bingo card is marked or flagged. As illustrated in FIG. 6A, a display device 320 displays the primary game 322 and a bingo game 324 as well as an input 326 that enables a player to collect a bingo element. As illustrated, the elements I 20, I 29 and O 69 have previously been randomly selected or selected in a predetermined sequence of elements. The player in one embodiment only has a limited time such as 15 minutes to collect the released elements. Therefore, in this example, the player collected the I 20, the I 29 and the O 69 all in the required amount of time. As illustrated in FIG. 6B, the gaming system continues to draw elements because there has not been a designated bingo winner.

As illustrated in FIG. 6B, the gaming system releases the element I 19. The player at the gaming machine uses the collected bingo number input 306 to select I 19 because they have I 19 on their bingo card. This game would continue until at least one of the players would obtain a designated symbol combination. That is, this process of selecting elements and marking any selected elements on the active bingo cards that are being played continues until one or more predetermined patterns are marked on one or more of the provided bingo cards. In one embodiment, the gaming machines require the players to collect a bingo element using an input to initiate process of the gaming machine marking or flagging the selected element. In another embodiment, if a player is actively playing and identified on a gaming machine, such as through a player tracking system, the gaming machine automatically marks any released elements on that player's bingo card. It should be appreciated that the game may include any suitable number of winning element combinations or patterns in a single game. For example, players may be provided a large prize for a blackout pattern and supplemental prizes are provided for four corners pattern.

It should be appreciated that the one or more winning cards patterns may be any suitable pattern such as but not limited to four corners, blackout, diagonal configuration, horizontal configuration, vertical configuration or any other suitable pattern. It should also be appreciated that the numbers or elements may be randomly drawn by a random number generator or by a weighted algorithm at the gaming device level or at central controller in any suitable manner. Such algorithms can take into account cards being played by the player and ranking the player. It should also be appreciated that numbers may be released in a predetermined sequence. In one embodiment, the gaming system prompts the player that an element is being released and provides that element to the player. In another embodiment, the gaming machine provides an icon or an audio clue that players should check their bingo cards. After a player has marked the winner's bingo pattern in one embodiment, the player can make an input to mark the sequence or element. In one embodiment, they lock their card and report to the club desk to claim their prize.

It should be appreciated that the player board or game board may be any suitable game board and may involve any level of skill.

In various embodiments, the collection game is provided more as a memory game where each player is required to uncover and match like elements or associated elements. In one embodiment, the first player to match all of the elements provided to them wins.

Figure 7A:
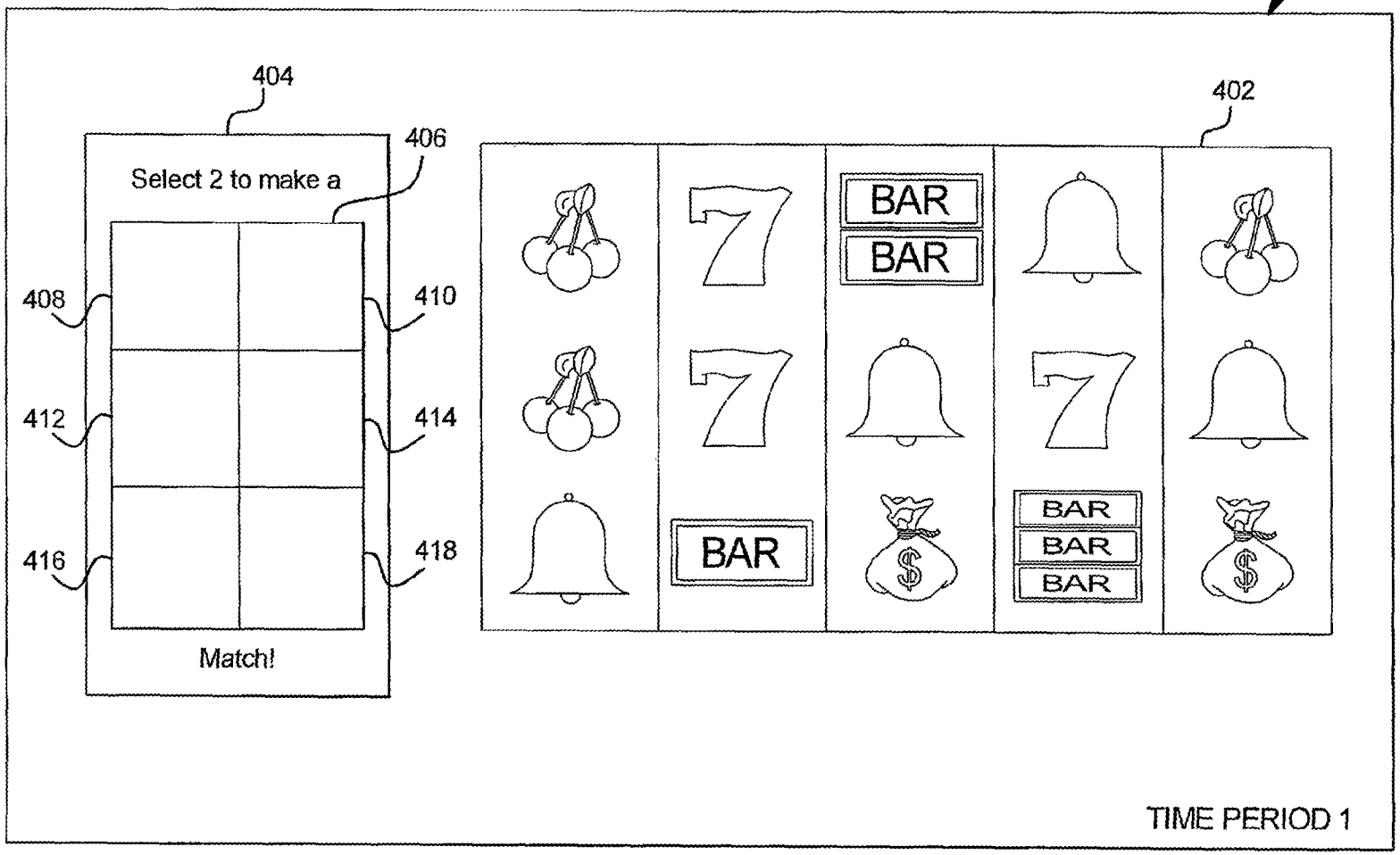
FIGS. 7A, 7B, 7C, 7D, 7E and 7F are screen shots of the collection game including a matching game.
Figure 7B:
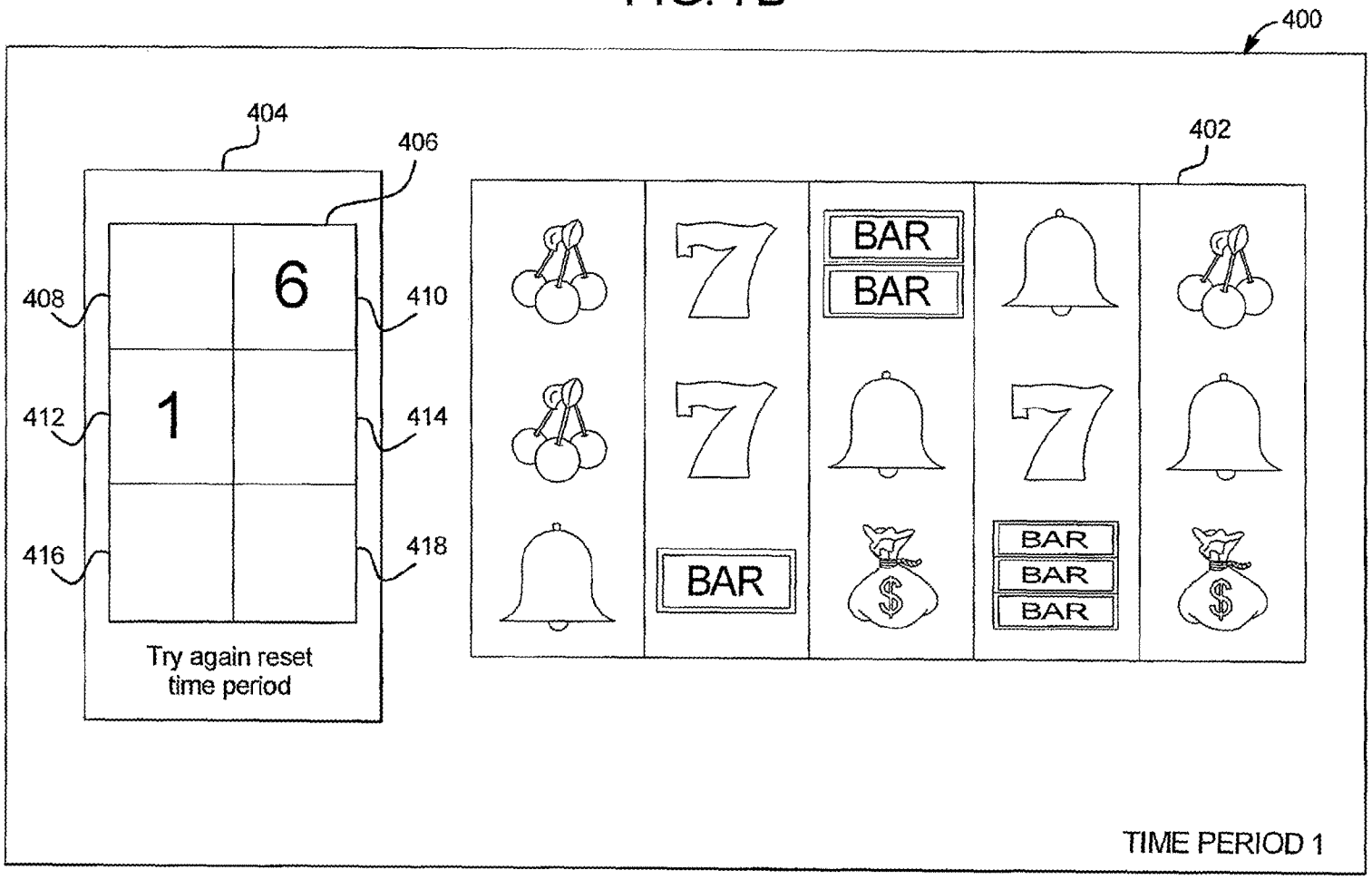

As illustrated FIGS. 7A, 7B, 7C, 7D, 7E and 7F in one embodiment upon an occurrence of a triggering event, instead of releasing an element to the players, the gaming system enables the player to play a game which includes one or more elements. As illustrated in FIG. 7A, at time period one the display device 400 of a gaming machine displays the primary game such as a slot game 402, and displays a service window 404 which displays a grid 406 of possible selections that a player can chose 408, 410, 412, 414, 416 and 418 during the game event. In one embodiment, the triggering event is a time period. For example, in FIGS. 7A through 7F the time period is every half hour. For example, every half hour the gaming system enables the players to make one match, if that match is correct they can try to make another match, but the goal is to match all of the symbols or elements on their game board. However, in one embodiment, if the player does not make a correct match, that game round is over for that player. A player may not choose more selections until another triggering event occurs for them to be able to make another match. As illustrated in FIG. 7B, the gaming machine enables the player to make a match. As illustrated in FIG. 7B, the player chooses the first selection on the right 410 and the second selection on the left 412. These sections reveal the elements of six and one respectively. Therefore, the player gets to try again, after an occurrence of a next triggering event to try and make a match. The game board does not change so the player now knows two of the element locations.

Figure 7C:
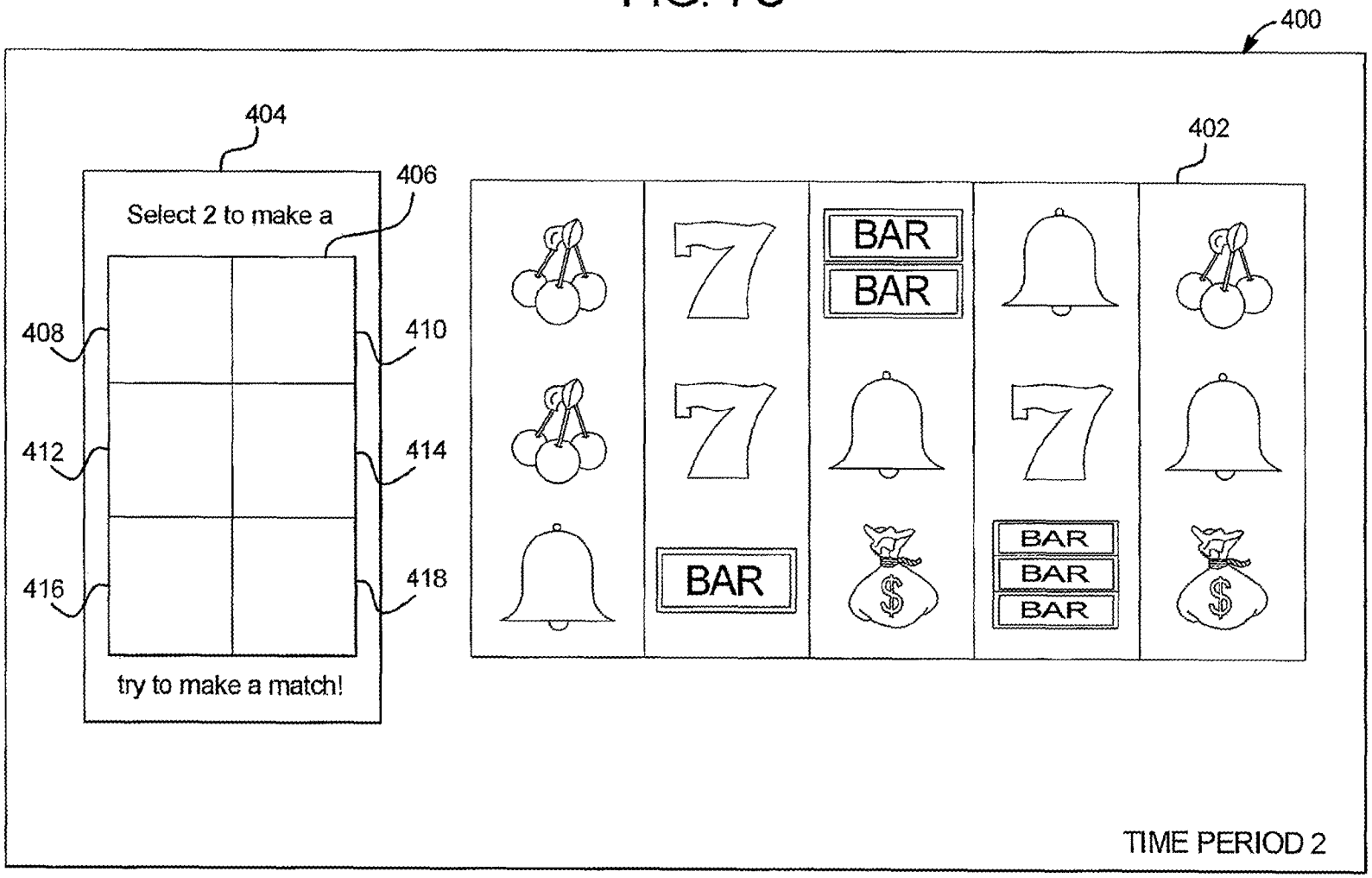
Figure 7D:
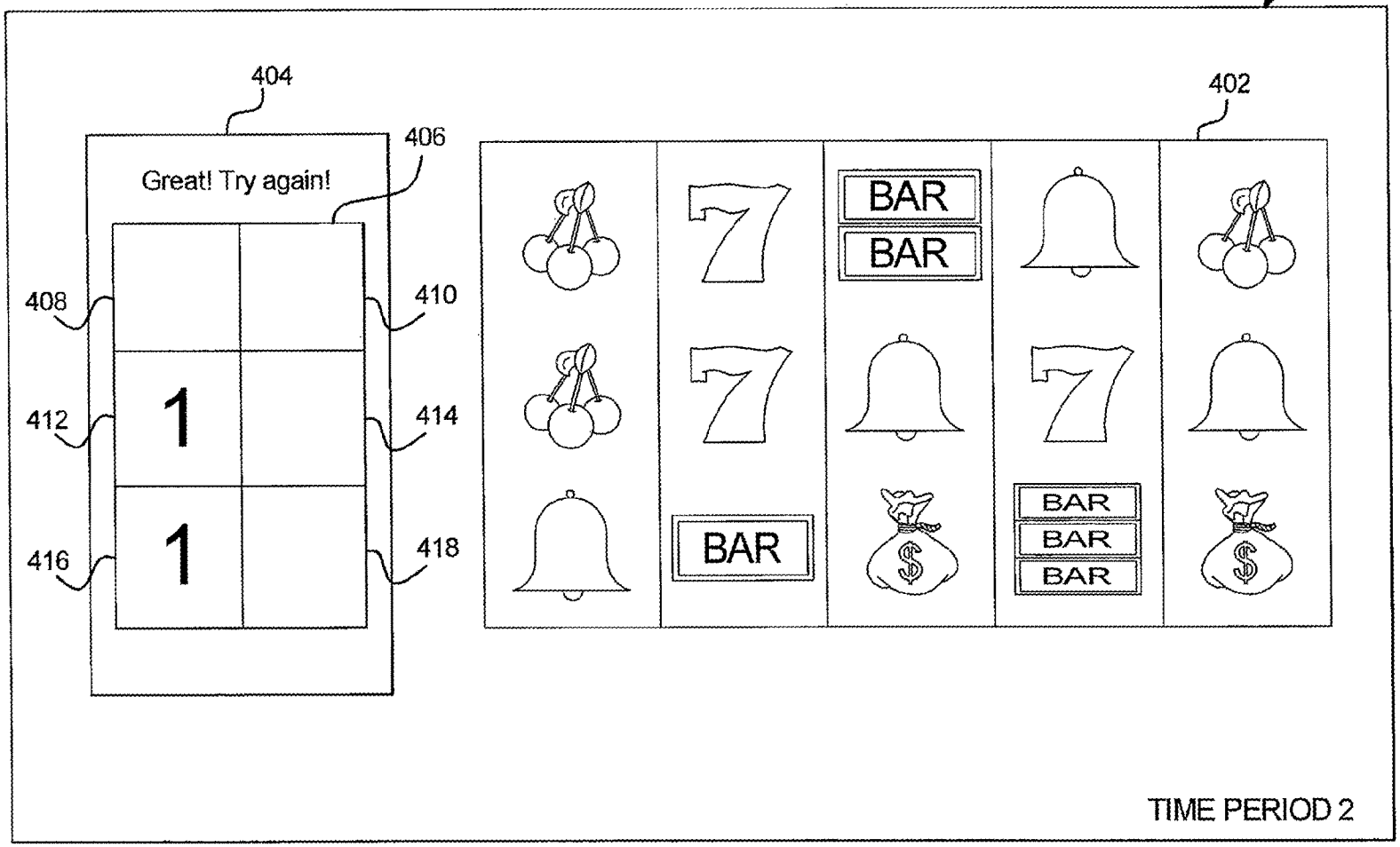
Figure 7E:
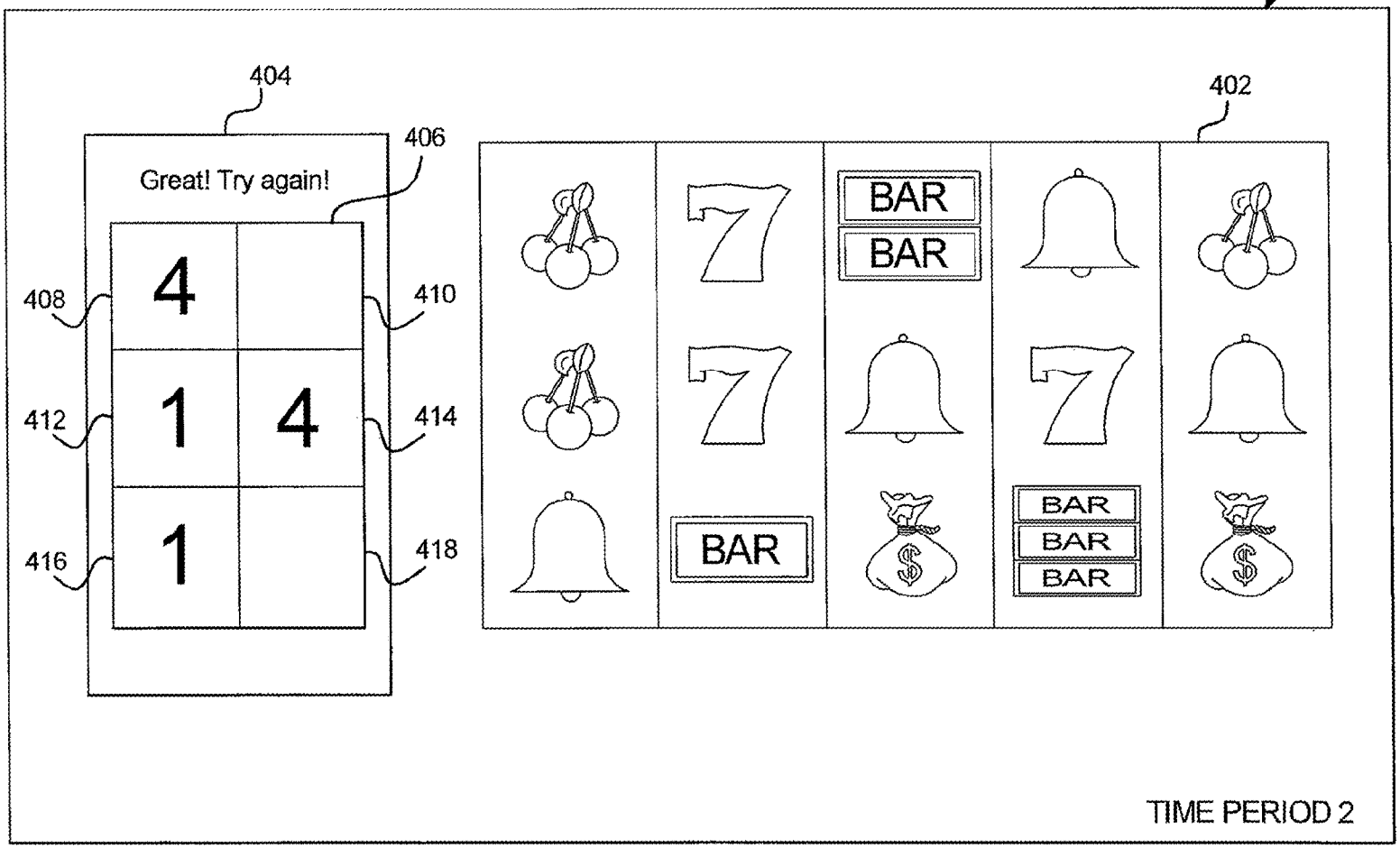
Figure 7F:
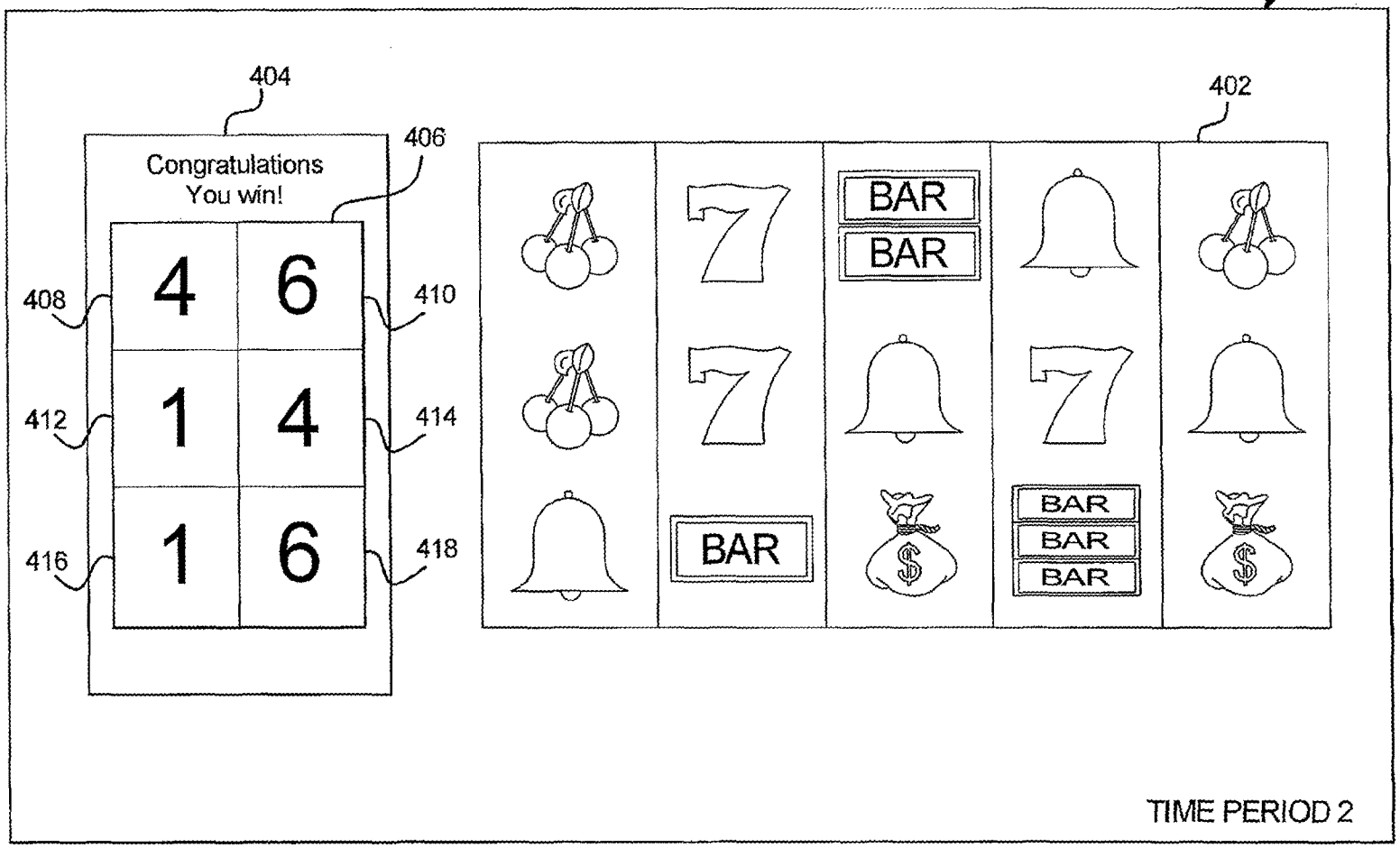

As illustrated in FIG. 7C at time period two, the gaming machine informs the player to make two selections to try to make a match. As illustrated in FIG. 7D, the player selects selection 416 and then selection 412 because both selections reveal the element one. As illustrated in FIG. 7E, the gaming system informs the player that they can try again. As illustrated in FIG. 7E, the player selects the first selection on the upper left 408 which reveals a four element and the second section on the right which reveals a four element as well. Therefore, the gaming machine then tells the player to try again. The player selects the two six's. Therefore, the player wins. The gaming machine provides the player with an award or prize. It should be appreciated the grid may be any suitable size and that it may be any suitable game that enables the player to have a skill element involved in the collection game or the persistence game.

In one embodiment, the collection game includes a plurality of different games or a plurality of different award levels at which a player may compete. In one embodiment, the players may compete in one, a plurality or each of the available levels of the collection game. Each of the different levels of collection games is independent from each other. That is, each of the levels has its own distinct prize and one or more independent winners. The winning criteria for the different levels of the collection games may be based on one or more different criteria. As illustrated in FIG. 8A, the chart illustrates a plurality of different levels of a collection game. As illustrated FIG. 8A, in one embodiment, the collection game includes three different levels. That is, the collection game includes three distinct games.

In one embodiment, the player inserts their card into a gaming machine to be registered for the collection game. It should be appreciated that any other method of identification may be used such as entering a pin number, biometric information, a personal identification number, or any other means for identification that can be used to identify a player at a gaming machine.

Upon the occurrence of the triggering event, the gaming system determines which level of the collection game to play. In one embodiment, the collection game is a bonus game. In another embodiment the collection game is a separate independent game provided at all of the gaming machines. In one embodiment, the gaming system randomly determines to provide a bonus round to one, a plurality or each of the levels of the collection game. In one embodiment, which level of the collection game or which prize level of the collection game is provided to players is randomly determined. Upon the occurrence of a triggering event or upon a random determination, the gaming system in one embodiment accesses a weighted table to determine which level of the game to provide to the players.

In one embodiment, the different levels have different probabilities of occurring. In one embodiment, a round of the collection game is triggered by an event. A triggering event may cause one, a plurality or each collection game level to occur. In one embodiment, upon an occurrence of a triggering event, the gaming system determines which collection game level or award level to play. That is, upon an occurrence of a triggering event, the gaming system only provides one level of the collection game play to the players.

For example, as illustrated in FIG. 8A, the first level of includes a probability of occurring 45 percent of time and in one embodiment is in the triggering range every 3 to 15 minutes. The collection game level two has a probability of occurring 40 percent of the time with a triggering range of 4 to 20 minutes. Collection game level three has a probability of occurring 15 percent of the time and occurring on the triggering range of 5 to 30 minutes. That is, upon an occurrence of a triggering event, the gaming system determines to play collection game level one 45% of the time, collection game level two 40% of the time and collection game level 15% of the time.

In one embodiment, a plurality or each of the prizes or awards is funded through a contribution of a percentage of each eligible player's wager. Thus, the amount the players are competing for increase each round. That is, the prizes the players are competing for increase the longer it takes for a player to solve the collection game. Additionally, the more players that play the collection game the higher the prize is. This prize rollover award jackpot for each level of the collection game provides the players a sense of urgency as more players join and the more time passes that someone's solving the collection game. The funding allows the game designers to allocate the funds in any appropriate manner. In one embodiment, the harder the game level is on average the longer it takes a player to match all in the elements a game. Therefore, the harder level games are appropriately funded, and thus, they are associated with a higher level prize.

It should be appreciated that each of the wagers at the gaming establishment may fund the awards. For another embodiment, only the wagers of participating players fund the awards. It should be appreciated that any suitable triggering event may cause a round of the collection game to be provided to the players. For example, a single time range, a coin-in threshold, random polling, symbol occurrences, game events, or any other suitable method may trigger a round of the collection game. In one embodiment, a single triggering event is used for each level of the collection game. In another embodiment, one or more different triggering events are used for each of the different levels. In one embodiment, the gaming system uses a single triggering event for each player. In one embodiment, the gaming system uses different triggering events for one or more different players. For example, a coin-in threshold triggering event may be the same for each player playing or different or personal to each player. The triggering events may be different for different players based on any suitable criteria including but not limited to player card status, player coin-in or the average amount wagered per player over a certain period of time.

In one embodiment, the funding of the collection game levels increases in a progressive meter. That is, each award is allocated the required percentage of total wagers that are placed by eligible players. In one embodiment, the funding is split evenly across all of the levels of the collection game. In another embodiment, the different collection levels are given different percentages of the wager to ensure that the harder or more challenging collection game levels have a higher prize value when they are won. This progressive meter continues between every round and for every bonus until at least one player completes and wins the collection game associated with that level.

For example, 25 percent of eligible players may be allotted for this collection game as illustrated in FIG. 8B. The first collection game level has a 6 percent level of contribution. The second collection game level has an 8 percent level of contribution. The third collection game level has an 11 percent level of contribution. Therefore, for each wager by a participating player, 25 percent of that wager funds the collection game. It should be appreciated that any suitable type of funding may be implemented for this award. For example, in one embodiment, the prizes are funded by marketing dollars or through other casino promotions.

In one embodiment, the different levels of the collection game are associated with an average expected time to play a round of the collection game based on the number of selections, the variability of the game, and the probability of winning the game. Additionally, the average number of expected players and the amount of play can be calculated to estimate the expected provided awards. For example, collection level one is expected to take 8 hours to win. Collection level two is expected to take 36 hours to win. Collection level three is expected to take 90 hours to win. If it is estimated that on average a 100 players will be competing for the prize at any time and that these players wager an average of $1,800 an hour each, the cumulative gaming coin in is $180,000 an hour. Using the contribution percentages of FIG. 8B, collection level one will be allocated $108 an hour. Collection level two will be allocated $144 an hour. Collection level three will be allocated $198 an hour. These numbers are based on the average play defined above. A surge of bets or a surge or decrease in the number of players at one time can greatly affect the value of the progressive collection game levels. Therefore, if collection level one is expected to be solved or won in 8 hours, the collection level one has an expected award around $864 (108×8). Collection level two has an expected award of $5,184 (144×36). Collection level three has an expected award of $17,820 (198×90). Thus, in one embodiment the harder the collection game level is to win, the higher the expected payout. The contribution rates are an example and can be tailored for any suitable reason for any suitable prize or award.

If more players join, the progressive collection levels awards build. However, because many people who have been there for a long time still have their same game board, the players who have been playing the collection game or persistence game for a longer time have a distinct advantage and therefore are likely to have a higher chance of winning than a player who just received a game board. That is, the player is likely to get more matches because they are more familiar with their game board because they have played in previous rounds revealing symbols than a player who just gets a brand new game board. That is, because experienced players have learned their game board and are familiar with at least a portion of the correct and incorrect choices they have made, these players have a higher likelihood of solving their game board than a first time player who is attempting to play with their game board for the first time.

It should be appreciated that the players may be able to play one, a plurality or all of the collection game levels. In one embodiment, a specific parameter determines which players are eligible to play in each prize level. For example, the card status of the player, the number of games the player has played, the amount wagered, and the amount won can be used to determine who is eligible for the next round of play. These parameters can be based on a total session of play or can be based on primary game play since the last round of play. Upon a triggering event into collection game round, new players will be assigned a game board if this is the first round they are playing. The gaming system provides players from a previous round the same game board that they had been previously playing on. In one embodiment, the gaming system provides the players the game board without any of the previous matches displayed. In another embodiment, the gaming system provides the players with the previous matches displayed. In each subsequent round, the player uses the game board until the collection game is over.

It should be appreciated that the levels and the funding of a collection game may be applied to any suitable collection game. FIGS. 8C to 8J illustrate a matching collection game.

As illustrated, in one embodiment, the collection game is a skill game and in order to win a player must match all of the elements of the collection game before any of the other players matches all the elements of the collection game. For each level a player wants to compete at, in one embodiment the gaming system provides a game board associated with the collection game. The player is provided a single game board per level of play of the collection game. In one embodiment, the game board is randomly generated by the gaming system. In one embodiment, the game board is unique or different for each player. Each player's game board remains the same throughout the entire collection game until the game terminates. Thus, the longer a player stays with the game and attempts to win, the better knowledge they have of their game board and their chance of making matches increases the more they play.

Figures 8C, 8D:
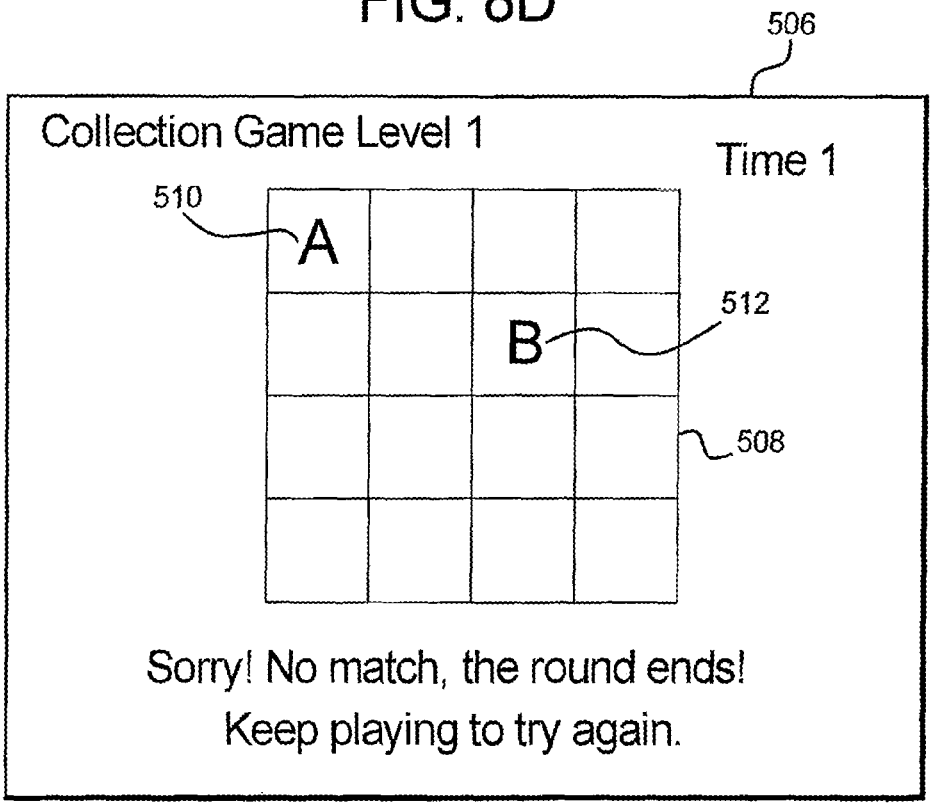
FIG. 8C is a chart illustrating different levels of difficulty for the collection game.
FIGS. 8D, 8E, 8F, 8G, 8H, 8I and 8J are screen shots illustrating play of one level of a collection game.

In addition to separate probabilities of occurrence and contribution rules, in one embodiment each level has a separate difficulty level. In one embodiment, the difficulty level is associated with the wager funding percentage to ensure that the more difficult the level the collection game is the higher the award will likely be. In one embodiment, the game is a match game. Therefore, the difficulty of the match game is determined based on the size of the matrix and the number of elements. As illustrated in FIG. 8C, the player must make more matches to win a highly funded collection game level due to the larger board size. As illustrated in FIG. 8C, collection game level one includes eight pairs and has a matrix size of 4×4. Therefore, the player has to achieve eight pairs first to win collection game level one. Collection game level two includes twelve pairs and the matrix size is 4×6. Therefore, the player must obtain four more matches in collection game two than in collection game level one. Collection game level three includes sixteen pairs and a 4×8 matrix. Therefore, to win collection game level three which has the highest percentage of contribution of the wagers, the player must obtain sixteen matches instead of twelve or eight.

In the match embodiment, the players play the game by selecting one of the tiles, selections, squares or cells of the grid to match a plurality to reveal an element. Once a first tile has been revealed, the gaming system provides the player an opportunity to pick a second tile. As the player matches the tiles, play continues. If the revealed elements match, the gaming system enables the players to make another collection. If the revealed elements do not match, the round is over for that player. The player may take notes of the elements revealed to help them remember the position of the elements because they will be the same for the next round unless someone wins the collection game in that round. In one embodiment, any achieved matches are saved for the player for the next round and they do not have to reveal them again. In another embodiment, though the positions of the matching elements remain the same, the player must select and reveal the previously matched elements again for each round.

For example, as illustrated in FIG. 8D in the first round of a game, a display device 506 of the gaming machine displays a matching collection game to a player 508. The player selects two tiles to reveal two elements A 510 and the B 512. A does not match B. The gaming machine informs the player that the player did not make a match so that round ends for the player but to keep playing to try again.

Figure 8E:
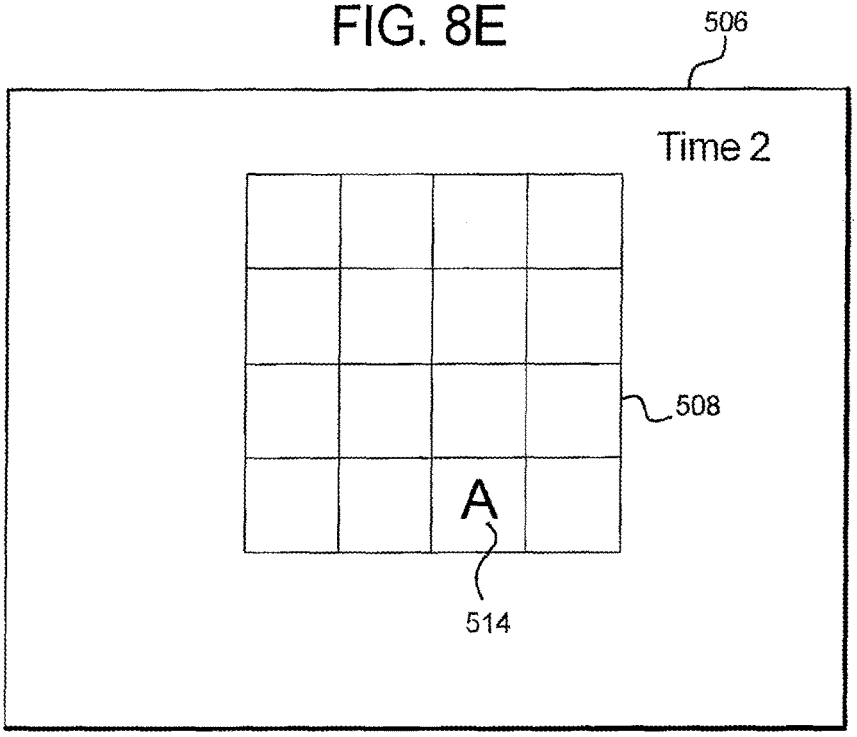
Figure 8F:
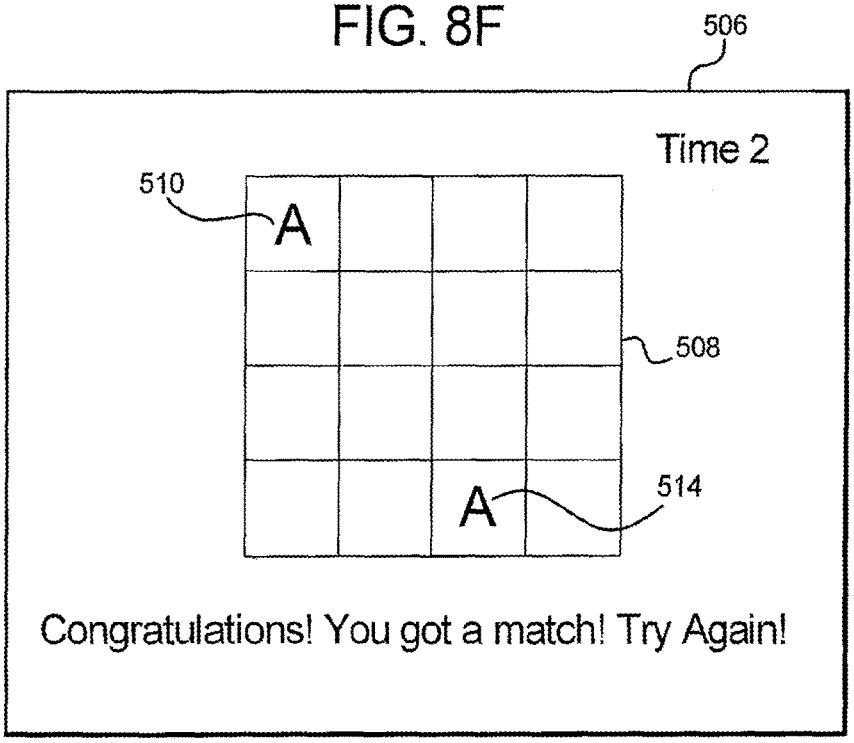

As illustrated in FIG. 8E at time 2, the gaming machine enables a player to pick one of the tiles to reveal one of the elements. As illustrated in FIG. 8E, the player picks another tile to reveal element A 514. As illustrated in FIG. 8F, the player then gets to select a second tile to try to make a match of the revealed element. The player previously picked element A 510. Therefore, the player remembers and picks the tile which conceals element A and makes a match. The gaming system enables the player to make another match because the player matched two of the elements. As illustrated in 8E, the gaming machine in one embodiment does not show the previously selected elements to the player upon completion of a round. That is, to win, the player has to make all of the matches in one round.

Figure 8G:
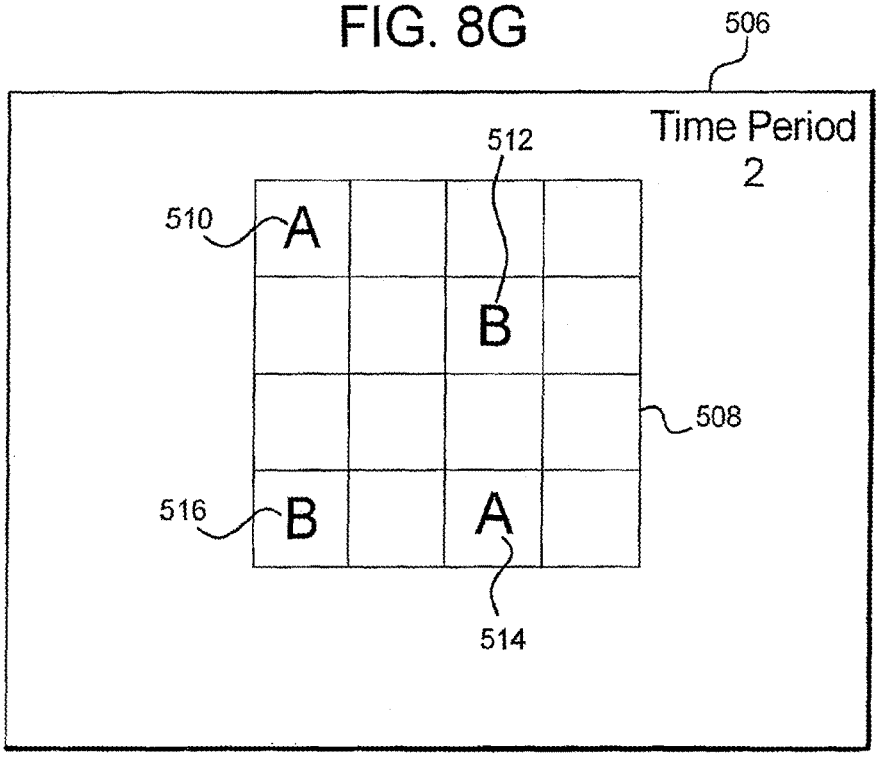
Figure 8H:
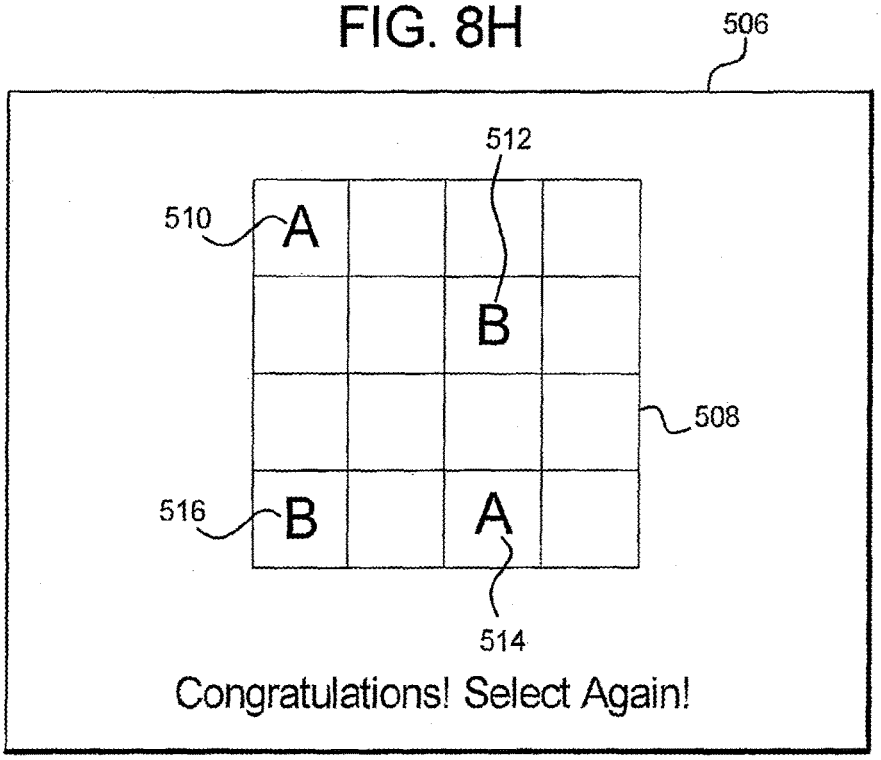
Figure 8I:
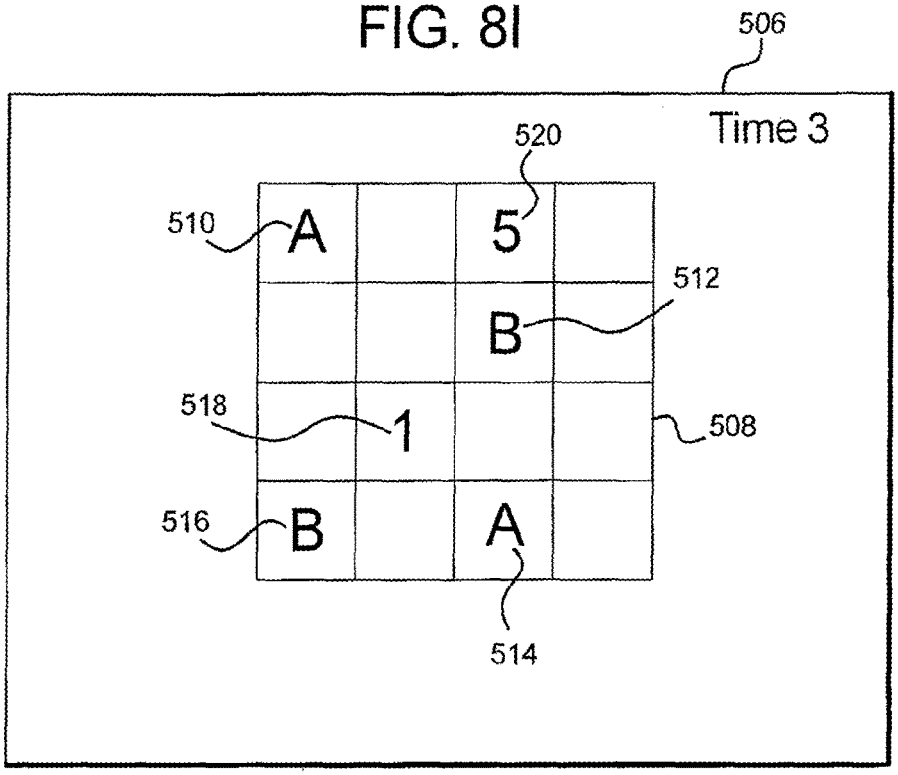
Figure 8J:
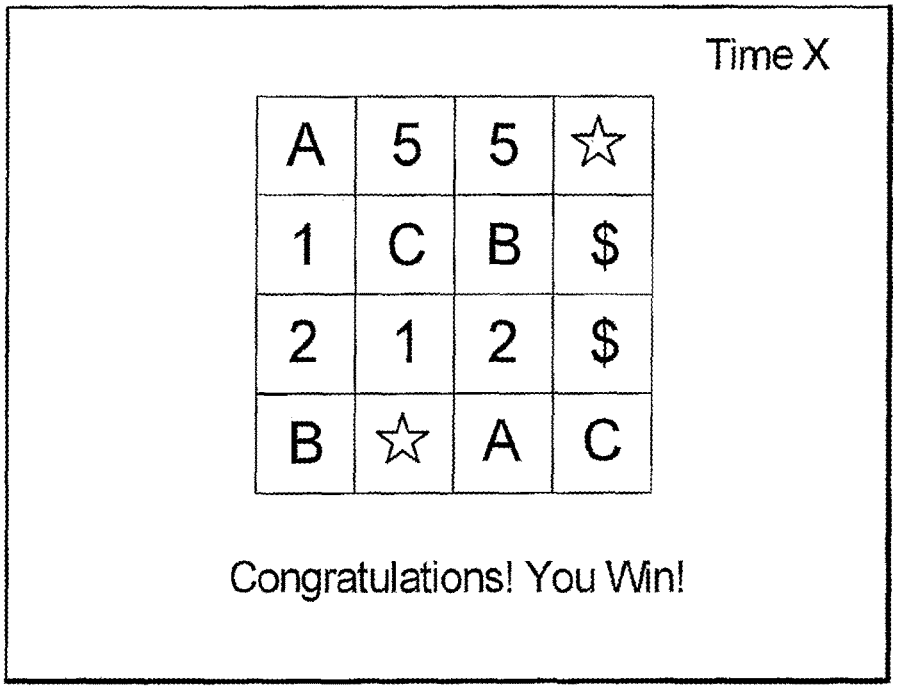

As illustrated in FIG. 8G, the player now selects a tile to reveal a new element 516. As illustrated in FIG. 8H, the player selects a tile that reveals a previously selected matching element 512. The gaming system informs the player that they get to play again. As illustrated in FIG. 8I, the player selects another tile to reveal element one 518. As illustrated in FIG. 8I, the gaming system enables the player to attempt to select another tile. The player selects another tile which reveals element five 520. The gaming system informs the player to keep playing to try again for another round. As illustrated in FIG. 8J, at time X, a player may choose all the matches on the game board before anyone else and they will win the collection game.

It should be appreciated in one embodiment, the player who matches all of the elements of the game board is winner of that game. It should be appreciated that in another embodiment each of the collection game levels or each of the collection games includes one or more different prizes for one or more occurrences of a designated event. For example, the first player who first matches a designated element wins an award in addition to any award won by the player to solve entire collection game first. As illustrated, the more players playing the game and the longer the players play the game the easier it will be for them to solve the collection game puzzle. Additionally, by having multiple prize levels competing at the same time, the multiple collection game levels will be less predictable and allow for larger prizes for players. It certain instances, a player may choose to play only certain of the prize levels to allow them to concentrate solely on that collection game level and to aim for prizes without being distracted and confused by playing multiple games or levels. In another embodiment, the player may play all of the designated games so the player is frequently playing the collection game while they are playing regular primary wagering games. It should be appreciated that in certain embodiments this collection game is designed to be fairly frequently presented to a player. However, the collection game is kept at a frequency as to become an annoyance and disruptions to the base or primary game. This collection game in one embodiment is something that excites players to enhance the base game play time not to take away from it.

In one embodiment, after each collection game round, when a player can claim the prize, the award amounts of each award level or prize level are updated with the incremented amount that occurred during the previous time period. If a collection game round occurs when a player can claim the prize, the increment that occurred during the previous collection game round will be used to fund a new amount for the next time that the collection game round is offered. This multiple award increment structure allows for one award level that will offer relatively small frequent prizes while another award level is more difficult having larger contribution rates and is awarded less frequently rates which results in larger prizes.

In one embodiment, when a plurality of players complete a collection game by completing all of the game requirements, that player will win his share of the offered prize divided equally among all the players who competed in that game round. For example, if the prize is 1,800 dollars and 4 players complete the collection game level at the same round, each will receive 450 dollars for their prize. In another embodiment, ways of splitting the award are provided such as based on total wager, player ranking, or any other suitable determination.

It should be appreciated that any suitable game may be used in this collection game with multiple levels. For example, including but not limited to a code breaker game, collection of icons, spelling of words, generation of numbers, or any other type of game. In one embodiment, the game is not a skill game but is simply a collection game when a player is given an element.

It should be appreciated that this collection game provides system wide bonus event that rewards players who play longer. However, in certain embodiments, any player may win at any time regardless of how long they have been playing. The funding also allows for awards to increase under a plurality of factors including how many players are playing, how difficult the collection game associated with that prize. This type of persistence game is simple and understandable but allows players to utilize strategy and still to obtain an advantage in the game. In one embodiment, this collection game works on any gaming machine and the ability to gather large groups to play allows prizes to get relatively large.

This structure encourages players to stay longer to player and to win their games and to use advantages they have gained in previous rounds. In one embodiment, the gaming establishment may customize how and when the games are offered and to whom. For example, they may offer the collection game or a certain level of the collection game only to certain players.

In a further embodiment, the gaming system enables players to collect different elements of the collection game based the type of game a player is playing and/or the type of gaming machine the player is play. That is, the gaming system rewards players in the collection game for playing on a plurality of different game platforms. For example, players may be awarded for playing all of the gaming machines or games from a certain manufacturer. In one embodiment, only certain games and/or gaming devices are part of this collection game gaming system. Playing different types of games and/or gaming devices enables players to try new types of games and different types of games. For example, the collection game is a bingo game and the gaming system provides players playing slot games elements in the "b" and "i" columns. The gaming system provides players playing poker games elements in the "n" and "g" columns. The gaming system provides players playing blackjack games elements in the "o" column. Therefore, to complete the collection game, the player must play a plurality of different types of games. The player may be required to play a plurality of different gaming machines and move around a gaming establishment to fulfill the collection game requirements.

It should be appreciated that any type of requirements may be made that encourage players to play on different gaming machines. In one embodiment, this gaming system encourages the players to play certain gaming machines. In another embodiment, the gaming system encourages players to play in one or more designated gaming establishments. For example, a player must obtain a designated element on a first gaming machine in a first gaming establishment and must obtain a second element on a second gaming machine in a second gaming establishment. In one embodiment, the gaming system encourages themed diversity of play. In another embodiment, the bonus gaming system includes time based play. The players must play at certain gaming devices at certain times to collect certain elements. For example, the player must play a first type of gaming machine between noon and 2:00 o'clock on Thursdays to collect a first type of element. The player must play the first type of gaming machine between noon and 2:00 o'clock on Fridays to collect a second type of element.

In another embodiment, to win a collection game a player must travel to different cities, states and/or countries. This model can encourage players to play the same gaming machines from the same manufacturer but encourages players to travel to try to win the collection game.

Thus, it should be appreciated that the present disclosure provides at least the following various embodiments.

In one embodiment, the present disclosure provides a gaming system and method of operating a gaming system including a plurality of gaming devices and a central controller configured to operate with the gaming devices to enable a plurality of players to play primary games and to provide a collection game that is independent from plays of the primary games. In each of a plurality of rounds of the collection game, the gaming system sequentially releases each of a plurality of elements of the collection game. In each round, the gaming system enables each player actively playing one of the gaming devices to collect less than all of the plurality of released elements. For each player, the gaming system accumulates the released elements collected by the player. When a designated number of players collect the elements of a designated winning combination of elements, the designated number of players being at least one, and the designated winning combination of elements being at least two, the gaming system operates with the gaming devices to display an indication of an award associated with the designated winning combination of elements.

In another embodiment, the present disclosure provides a gaming system and method of operating a gaming system including a plurality of gaming devices and a central controller configured to operate with the gaming devices to enable a plurality of players to play primary games and to provide a plurality of community award opportunities which are independent from plays of the primary games. The gaming system makes each community award opportunity available at predetermined intervals, where the community award opportunity is simultaneously available to a plurality of the gaming devices, and at least one of the predetermined intervals extends over multiple plays of the primary game of one or more of the plurality of gaming devices. The gaming system displays one of the community award opportunities at each of the predetermined intervals. The gaming system associates a plurality of the community award opportunities with one of the gaming devices, where at least two of the associated award opportunities are displayed at non-sequential predetermined intervals, and the at least two associated award opportunities are sequentially associated with the one gaming device. The gaming system also determines a community award win event upon one of the plurality of gaming devices being associated with a predetermined configuration of the community award opportunities, and causes the gaming device associated with the predetermined configuration of the community award opportunities to provide an award to a player.

In another embodiment, the present disclosure provides a gaming system and method of operating a gaming system including a plurality of gaming devices and a central controller configured to operate with the gaming devices to enable a plurality of players to play primary games and to provide a collection game which is independent from plays of the primary games. The collection game includes one or more rounds which extend over multiple plays of the primary game of one or more of the plurality of gaming devices. In each of a plurality of rounds of the collection game that are each independent from play of the game operable upon the wager, the gaming system randomly draws one or more elements, and for each player actively playing one of the gaming devices, enables the player to collect the drawn element if that element is included on the player's game board. The gaming system marks each collected element on the game board and determines if any of any marked elements are in a winning element pattern on one of the game boards. If the marked elements are not a winning element pattern on any one of the game boards of the participating players, the gaming system repeats the process of drawing and releasing elements for collection by the players. If the marked elements are in a winning element pattern on one of the game boards, the gaming system displays an award for the player with the winning element pattern.

In another embodiment, the present disclosure provides a gaming system and method of operating a gaming system including a plurality of gaming devices and a central controller configured to operate with the gaming devices to enable a plurality of players to play primary games and to provide a plurality of community award opportunities which are independent of the play of the primary games. For each of a plurality of community award opportunities, the gaming system makes the community award opportunity available at predetermined intervals, where the community award opportunity is simultaneously available to a plurality of the gaming devices and one of the predetermined intervals extends over multiple plays of the game of one or more of the plurality of gaming devices. The gaming system displays a community award opportunity at each of the predetermined intervals, causes a different predetermined configuration requirement to be associated with a plurality of the gaming devices, and associates a plurality of the community award opportunities with a plurality of the gaming machines. The gaming system further determines a community award win event upon satisfying the predetermined configuration requirement associated with one of the gaming devices and causes the gaming device associated with the satisfied predetermined configuration requirement to provide an award to a player.

In another embodiment, the present disclosure provides a gaming system and method of operating a gaming system including a plurality of gaming devices and a central controller configured to operate with the gaming devices to enable a plurality of players to play primary games and to provide a plurality of community award opportunities which are independent of the play of the primary games. For each of a plurality of community award opportunities, the gaming system makes the community award opportunity available at predetermined intervals, where the community award opportunity is simultaneously available to a plurality of the gaming devices and one or more of the predetermined intervals extends over multiple plays of the game of one or more of the plurality of gaming devices. The gaming system displays the community award opportunity at each of the predetermined intervals and receives communications from a plurality of the plurality of gaming devices in response to the community award opportunity being displayed. The gaming system determines if one of the gaming devices is a community award winner based on the received communications and repeats the above step until one of the gaming devices is determined to be the community award winner. The gaming system causes the gaming device determined to be the community award winner to provide an award to a player and subsequently repeat the process with a different community award opportunity.

It should be appreciated that the awards may be any suitable awards including but not limited to free spins, cash, credits, coupons, multipliers, vouchers, gift certificates, entry into a bonus pool or tournament, free games, a physical prize, such as a car or different type of prize, such as a vacation or a free night at the gaming establishment's hotel. In another embodiment, the award for the collection game is not disclosed to the players. That is, one or more awards are a mystery to the players.

It should be appreciated that the collection game may include any suitable number of awards or prizes. For example, a collection game may include three awards, for the first three people to solve the collection game. In one embodiment, the collection game includes intermittent awards. For example, the first player to collect a subset of elements wins an award in addition to the player who solves the collection game first winning an award. A collection game may provide players awards based on any suitable criteria.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A method of operating a gaming system, the method comprising:

(a) initiating, by at least one processor, a play of a multi-player collection game for a plurality of players after receipt of a separate fee from each of the plurality of players via a plurality of payment acceptors which each receive a separate physical item associated with a monetary value;

(b) selecting, by the at least one processor, one of a plurality of different elements;

(c) causing, by the at least one processor, at least one display device to display the selected element to each of the plurality of players;

(d) determining, by the at least one processor, whether any of the plurality of players made any collection inputs within a duration of time following the display of the selected element to each of the plurality of players;

(e) responsive to a determination that at least one of the plurality of players made at least one collection input within the duration of time following the display of the selected element to each of the plurality of players, for one of the plurality of players that made the collection input, collecting, by the at least one processor, the selected element for only that player;

(f) repeating (b) to (e) until a win event occurs; and (g) responsive to an occurrence of the win event:

(1) determining, by the at least one processor, a winning one of the plurality of players based on that player's collected elements;

(2) causing, by the at least one processor, the at least one display device to display an award for the winning player; and (3) ending, by the at least one processor, the play of the multi-player collection game.

2. The method of claim 1, which includes preventing, by the at one processor and responsive to an occurrence of a suspension event for one of the plurality of players based on that player's collected elements, that player from collecting any elements for a period.

3. The method of claim 2, wherein the period includes a period of time.

4. The method of claim 2, wherein the suspension event occurs for one of the plurality of different players responsive to collection of one of the plurality of different elements for that player.

5. The method of claim 1, wherein the win event occurs based on the collected elements of at least one of the plurality of different players.

6. The method of claim 1, wherein the multi-player collection game is independent of any primary game play of the plurality of players.

7. The method of claim 1, wherein selecting the one of the plurality of different elements includes randomly selecting, by the at least one processor, the one of the plurality of different elements.

8. The method of claim 1, which includes receiving the collection input via a touch screen.

9. A gaming system comprising:

at least one processor; and at least one memory device that stores a plurality of instructions that, when executed by the at least one processor, cause the at least one processor to:

(a) initiate a play of a multi-player collection game for a plurality of players after receipt of a separate fee from each of the plurality of players via a plurality of payment acceptors which each receive a separate physical item associated with a monetary value;

(b) select one of a plurality of different elements;

(c) cause at least one display device to display the selected element to each of the plurality of players;

(d) determine whether any of the plurality of players made any collection inputs within a duration of time following the display of the selected element to each of the plurality of players;

(e) responsive to a determination that at least one of the plurality of players made at least one collection input within the duration of time following the display of the selected element to each of the plurality of players, for one of the plurality of players that made the collection input, collect the selected element for only that player;

(f) repeat (b) to (e) until a win event occurs; and (g) responsive to an occurrence of the win event:

(1) determine a winning one of the plurality of players based on that player's collected elements;

(2) cause the at least one display device to display an award for the winning player; and (3) end the play of the multi-player collection game.

10. The gaming system of claim 9, wherein the plurality of instructions, when executed by the at least one processor, cause the at least one processor to, responsive to an occurrence of a suspension event for one of the plurality of players based on that player's collected elements, prevent that player from collecting any elements for a period.

11. The gaming system of claim 10, wherein the period includes a period of time.

12. The gaming system of claim 10, wherein the suspension event occurs for one of the plurality of different players responsive to collection of one of the plurality of different elements for that player.

13. The gaming system of claim 9, wherein the win event occurs based on the collected elements of at least one of the plurality of different players.

14. The gaming system of claim 9, wherein the multi-player collection game is independent of any primary game play of the plurality of players.

15. The gaming system of claim 9, wherein the plurality of instructions, when executed by the at least one processor, cause the at least one processor to randomly select the one of the plurality of different elements.

16. The gaming system of claim 9, wherein the collection input is received via a touch screen.

17. The gaming system of claim 9, wherein the at least one processor includes at least one server processor.

18. A method of operating a gaming system, the method comprising:

(a) responsive to receiving a separate fee from each of a plurality of players via a plurality of payment acceptors which each receive a separate physical item associated with a monetary value, initiating, by at least one processor, a play of a multi-player collection game for the plurality of players, wherein the multi-player collection game is independent of any primary wagering game play of any of the plurality of players;

(b) selecting, by the at least one processor, one of a plurality of different elements;

(c) causing, by the at least one processor, at least one display device to display the selected element to the plurality of players;

(d) determining, by the at least one processor, whether any of the plurality of players made any collection inputs within a duration of time following the display of the selected element to each of the plurality of players;

(e) responsive to a determination that at least one of the plurality of players made at least one collection input within the duration of time following the display of the selected element to each of the plurality of players, for one of the plurality of players that made the collection input, collecting, by the at least one processor, the selected element for only that player;

(f) repeating (b) to (e) until a win event occurs;

(g) preventing, by the at one processor and responsive to an occurrence of a suspension event for one of the players based on that player's collected elements, that player from collecting any elements for a period; and (h) responsive to an occurrence of the win event:

(1) designating, by the at least one processor, one of the plurality of players as a winning player based on that player's collected elements;

(2) providing an award to the winning player; and (3) ending, by the at least one processor, the play of the multi-player collection game.

* * * * *